US008291630B2

(12) United States Patent
Schwartz

(10) Patent No.: US 8,291,630 B2
(45) Date of Patent: Oct. 23, 2012

(54) SWATCH AND SIGN HOLDER

(75) Inventor: Lily Schwartz, Rogers, MN (US)

(73) Assignee: Target Brands, Inc., Minneapolis, MN (US)

( * ) Notice: Subject to any disclaimer, the term of this patent is extended or adjusted under 35 U.S.C. 154(b) by 132 days.

(21) Appl. No.: 12/962,832

(22) Filed: Dec. 8, 2010

(65) Prior Publication Data

US 2012/0144708 A1 Jun. 14, 2012

(51) Int. Cl.
*G09F 7/00* (2006.01)

(52) U.S. Cl. ..... 40/611.07; 40/611.06

(58) Field of Classification Search ..... 40/611.06, 40/611.07, 606.19; 281/27
See application file for complete search history.

(56) References Cited

U.S. PATENT DOCUMENTS

| | | | | | |
|---|---|---|---|---|---|
| 650,630 | A | | 5/1900 | Chamberlain | |
| 1,398,364 | A | | 11/1921 | Davidson | |
| 1,952,478 | A | * | 3/1934 | Stine | 206/487 |
| 2,121,246 | A | * | 6/1938 | Gordon | 434/367 |
| 2,179,768 | A | | 3/1939 | Weinlich | |
| RE21,845 | E | | 6/1941 | Weinlich | |
| 2,581,762 | A | | 1/1952 | Hesse | |
| 2,629,952 | A | | 3/1953 | Gazan, Jr. | |
| 4,318,238 | A | * | 3/1982 | Macarle, Jr. | 40/492 |
| 4,456,122 | A | | 6/1984 | Kalal | |
| 4,458,435 | A | * | 7/1984 | Ackerman | 40/530 |
| 4,521,981 | A | | 6/1985 | Kasprzycki et al. | |
| 4,896,779 | A | | 1/1990 | Jureckson | |
| D335,781 | S | | 5/1993 | Moncrief et al. | |
| 5,228,857 | A | | 7/1993 | Roland | |
| 5,609,484 | A | | 3/1997 | Hawiuk | |
| 5,647,485 | A | | 7/1997 | Verrangia | |
| D384,229 | S | | 9/1997 | Verrangia | |
| 5,855,480 | A | | 1/1999 | Housman | |
| 6,484,429 | B1 | | 11/2002 | Przylucki | |
| 6,681,510 | B1 | | 1/2004 | Salatin et al. | |
| 6,902,064 | B2 | | 6/2005 | Wang et al. | |
| 6,955,261 | B2 | | 10/2005 | Ploix et al. | |
| 7,097,049 | B1 | | 8/2006 | Singer et al. | |
| 7,210,587 | B1 | | 5/2007 | Singer et al. | |

* cited by examiner

*Primary Examiner* — Ruth Ilan
*Assistant Examiner* — Kristina Junge
(74) *Attorney, Agent, or Firm* — Leanne Taveggia Farrell; Westman, Champlin & Kelly, P.A.

(57) ABSTRACT

A swatch and sign holder includes a base, a sign and a cover. The base includes a front face having a front surface, a back surface and at least one through slot extending from the front surface to the back surface. The sign includes a front surface, a back surface, at least one through slot extending from the front surface to the back surface and indicia printed on the front surface of the sign. The back surface of the sign engages into contact with the front surface of the front face. The cover secures the sign to the front face of the base. Each through slot of the front face and each through slot of the sign align with each other to receive a fabric swatch.

19 Claims, 24 Drawing Sheets

SWATCH AND SIGN HOLDER

BACKGROUND

Retail establishments use various types of display structures to present products or samples of products to customers for purchase and to provide signage for conveying sale and/or product information. An example display structure includes peg-type display fixtures. Peg-type display fixtures mount to a peg board.

One type of peg-type display fixture displays products by hanging the products from a peg attached to the peg board. Another type of peg-type display fixture includes a fixture attached to a peg for receiving and displaying signage having images, graphics and/or texts.

The discussion above is merely provided for general background information and is not intended to be used as an aid in determining the scope of the claimed subject matter.

SUMMARY

A swatch and sign holder includes a base, a sign and a cover. The base includes a front face having a front surface, a back surface and at least one through slot extending from the front surface to the back surface. The sign includes a front surface, a back surface, at least one through slot extending from the front surface to the back surface and indicia printed on the front surface of the sign. The back surface of the sign engages into contact with the front surface of the front face. The cover secures the sign to the front face of the base. Each through slot of the front face and each through slot of the sign align with each other to receive a fabric swatch.

The base of the swatch and sign holder is engaged with a display structure. The base includes a receiver having a pair of spacers and a frame. The frame is received by the display structure such that the front face, the sign and the cover protrude outwardly from the display structure via the pair of spacers.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Embodiments are described as a swatch and sign holder including multiple components fitted together to provide features for supporting swatches and features for supporting a sign. The swatch and sign holder is received by a display structure for supporting the swatch and sign holder for display. In particular, the swatch and sign holder include a base, a sign and a cover. The cover holds the sign to the front of the base. Each of the base, the sign and the cover includes corresponding through slots that align together for receiving swatches. A swatch or fabric swatch is a sample piece or strip of material, such as fabric or cloth.

Figure 1:
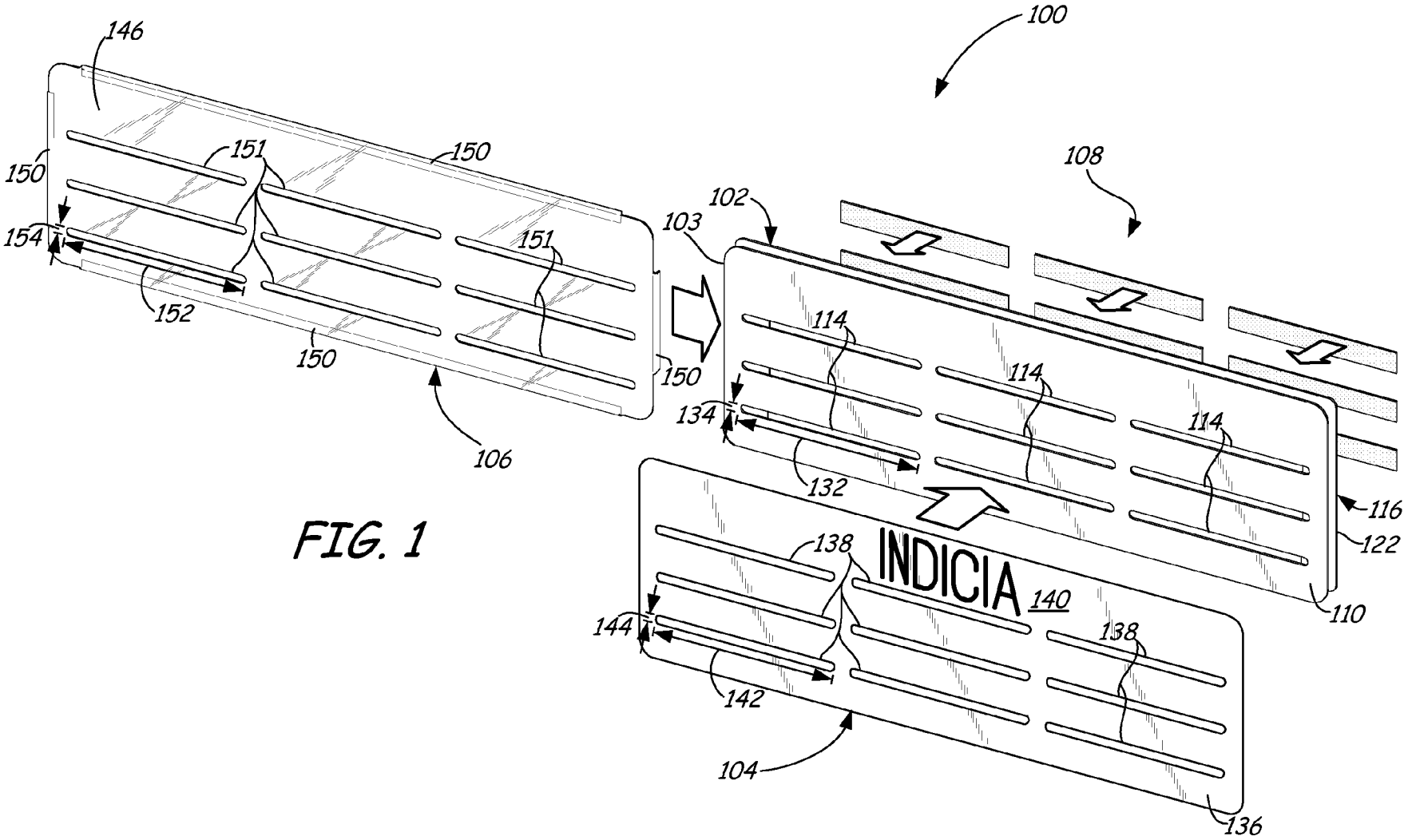
FIG. 1 illustrates an exploded perspective view of a swatch and sign holder under one embodiment.

FIGS. 1-10 illustrate various views of a swatch and sign holder 100 under one embodiment. FIG. 1 is an exploded perspective view of swatch and sign holder 100, while FIGS. 2-10 illustrate swatch and sign holder 100 assembled. More specifically, FIGS. 1-4 illustrate perspective views of swatch and sign holder 100, while FIGS. 6-10 illustrate elevation views of swatch and sign holder 100. Swatch and sign holder 100 includes a base or fabric swatch display 102, a sign or substrate 104, a cover or cap 106 and at least one hook and/or loop piece 108.

In one embodiment, the components of base 102 are made of an opaque material, such as colored high impact polystyrene (HIPS). However it should be realized that other types of materials are possible including translucent or transparent materials as well as other types of plastics. Base 102 includes a front face 103 having a front surface 110, a back surface 112 (FIGS. 6-8), at least one through slot or aperture 114 that extends from the front surface 110 to the back surface 112. Base 102 also includes a receiver 116.

Figure 6:
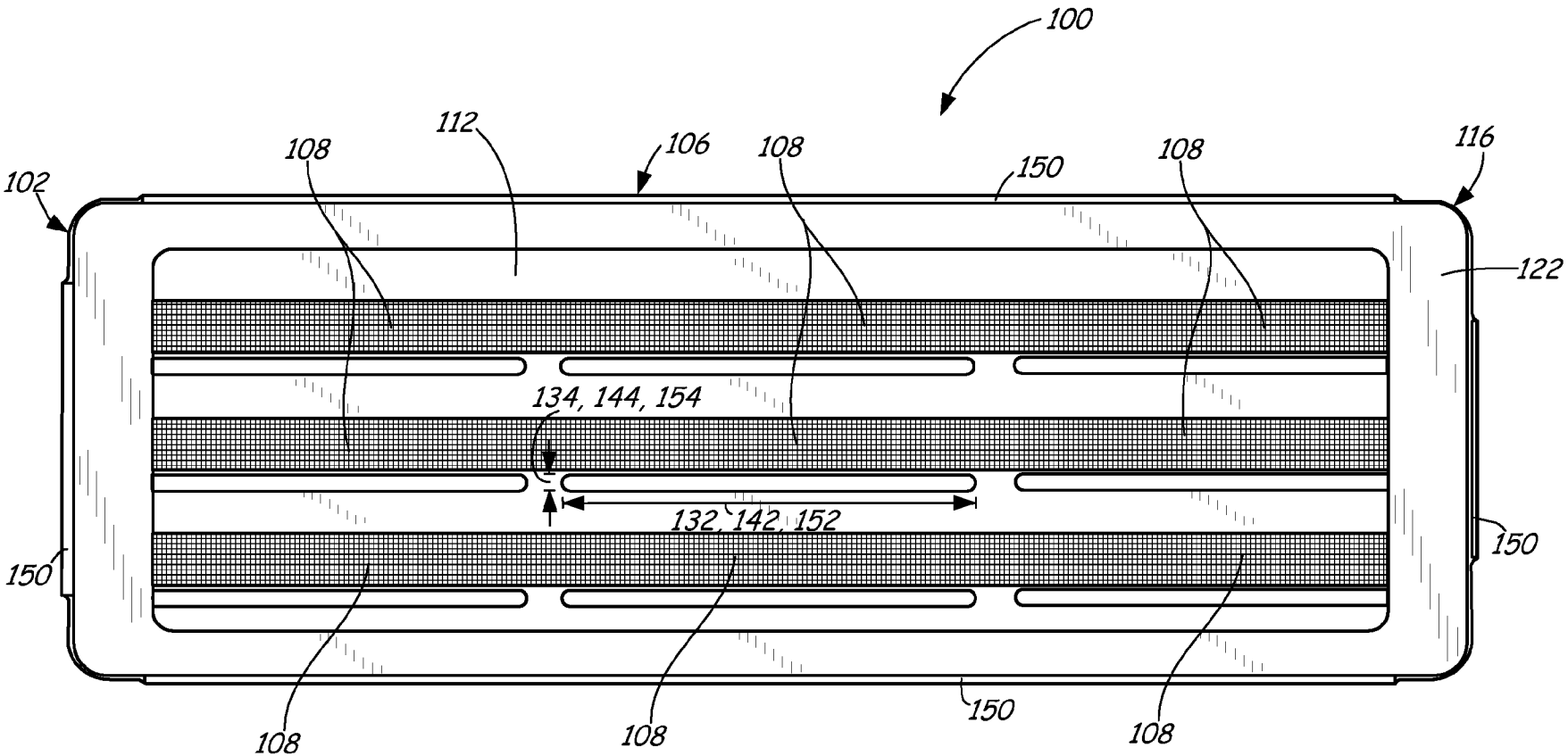
FIG. 6 illustrates a back view of the swatch and sign holder illustrated in FIG. 3.
Figure 7:
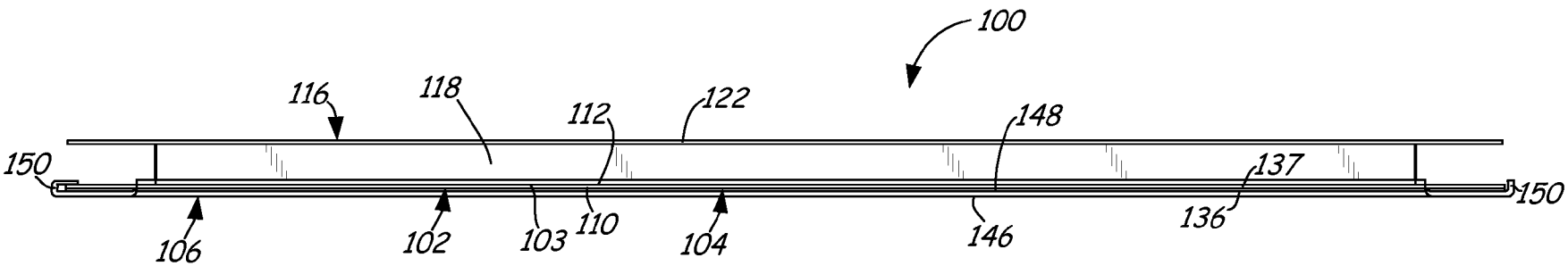
FIG. 7 illustrates a top view of the swatch and sign holder illustrated in FIG. 3.
Figure 8:
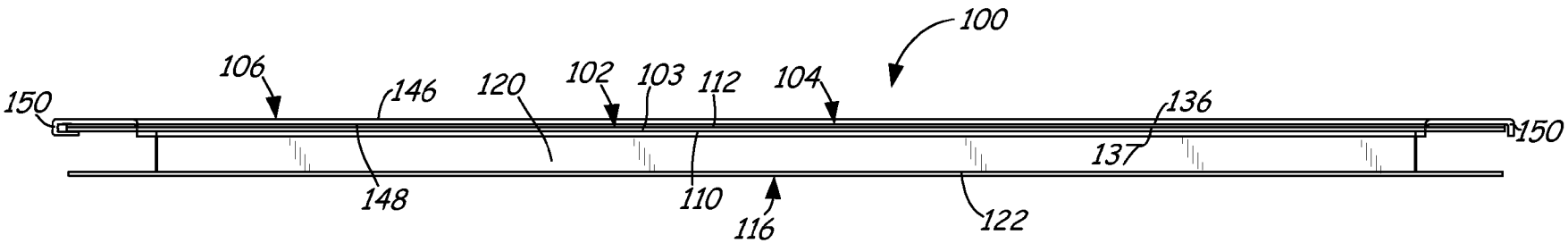
FIG. 8 illustrates a bottom view of the swatch and sign holder illustrated in FIG. 3.
Figure 9:
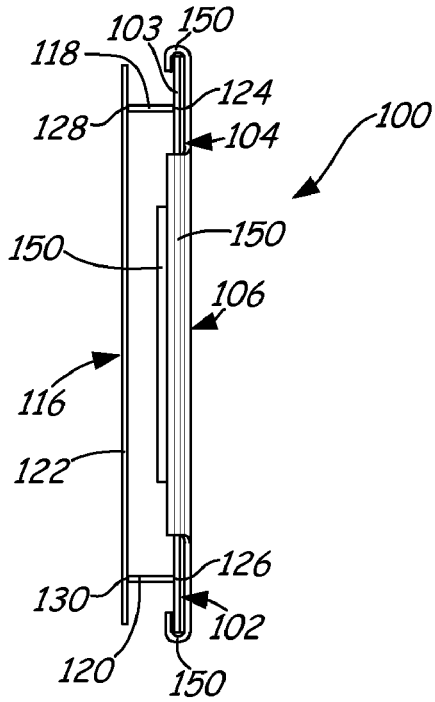
FIG. 9 illustrates a left side view of the swatch and sign holder illustrated in FIG. 3.
Figure 10:
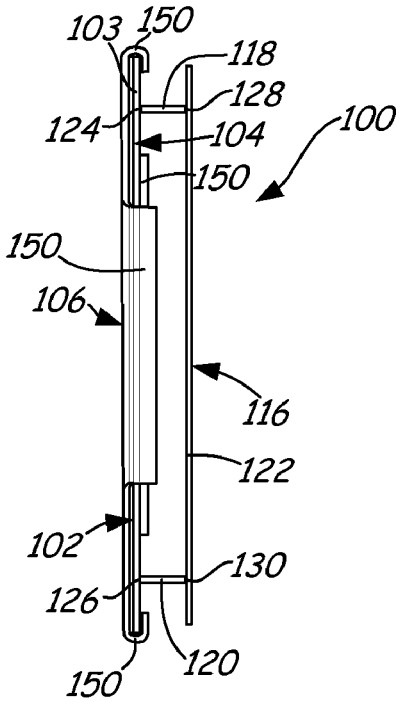
FIG. 10 illustrates a right side view of the swatch and sign holder illustrated in FIG. 3.

As illustrated in FIGS. 1 and 6, the at least one hook and/or loop piece 108 is, for example, made of Velcro® and is mounted or attached to the back surface 112 of base 102 as indicated by the directional arrow in FIG. 1. In one embodiment and as illustrated in FIG. 1, hook and/or loop pieces 108 can include one piece per through slot 114 or nine total. In another embodiment and as illustrated in FIG. 6, hook and/or loop pieces 108 can include one piece per row of through slots 114. Regardless, as shown in FIG. 6, the at least one piece 108 is of hook material and such hook material faces outwardly from the back surface 112 of base 102 as indicated in cross-hatch. However, it should be realized that, in the alternative, the at least one piece 108 can be loop material and such loop material could face outwardly from the back surface 112 of front face 103. As illustrated in FIG. 6, each hook and/or loop piece 108 is mounted or adhered to back surface 112 of base 102 adjacent each through slot 114. As illustrated, each piece 108 is adhered above each through slot 114. However, it should be realized that the at least one hook and/or loop piece 108 could also be adhered below each through slot 114.

Receiver 116 includes a pair of spacers 118 and 120 (FIGS. 7-10) and a frame 122. In one embodiment, receiver 116 is made of the same opaque material as the front face 103 of base 102, such as colored HIPS. However, it should be realized that receiver 116 need not be made of the same material as the remainder of base 102 and could be made of other materials including translucent or transparent materials and other types of plastics. First edges 124 and 126 (FIGS. 9 and 10) of the pair of spacers 118 and 120 are mounted or adhered to back surface 112 of front face 103 while opposing sides 128 and 130 (FIGS. 9 and 10) couple to frame 122. For example, spacers 118 and 120 can be separate components from frame 122 such that sides 128 and 130 are second edges. In the alternative, spacers 118 and 120 can be integrally formed with frame 122. As illustrated in FIGS. 7-10, spacer 118 is located above spacer 120 and extends along front face 103 and frame 122 a distance that is substantially equivalent to a distance spacer 120 extends along front face 103 and frame 122. However, it should be realized that spacers 118 and 120 can extend any select distance including having different distances.

Base 102 includes nine through slots 114 centered on front face 103 in a 3×3 matrix. In other words, each through slot 114 is in alignment with two other through slots 114 in a horizontal direction and in alignment with two other through slots 114 in a vertical direction. Each through slot 114 includes an elongated opening having a width 132 large enough to accommodate a fabric sample width and a height 134 large enough to accommodate a fabric sample thickness. More specifically, each of through slots 114 includes width 132 being greater than height 134.

Sign or substrate 104 includes a front surface 136, a back surface 137 (FIGS. 7 and 8), at least one through slot or aperture 138 and indicia 140. Each through slot 138 extends from front surface 136 to the back surface 137. In one embodiment, sign 104 can be made of a sheet material. However, other similar materials or substrates are possible that can receive printed text, images and/or graphics. The back surface 137 of sign 104 is configured to engage into contact with the front surface 110 of front face 103 as illustrated by the directional arrow in FIG. 1. Each through slot 138 of sign 104 corresponds with the location and alignment of each through slot 114 of base 102. In particular, sign 104 includes nine through slots 138 centered in a 3×3 matrix. Each through slot 138 is in alignment with two other through slots 138 in a horizontal direction and in alignment with two other through slots 138 in a vertical direction. Each through slot 138 includes an elongated opening having a width 142 large enough to accommodate the fabric sample width and a height 144 large enough to accommodate the fabric sample thickness. More specifically, each of through slots 138 of sign 104 are substantially equivalent to each through slot 114 of base 102 including width 142 being substantially similar to width 132 and height 144 being substantially similar to height 134. Indicia 140, which can include printed images, graphics and/or text, can be located anywhere on front surface 136 of sign 104. The location of indicia 140 on front surface 136 as illustrated in FIGS. 1-5 is for exemplary purposes only.

In one embodiment, cover or cap 106 is made of a translucent material or a material having at least some transparency, such as a non-glare clear polyethylene terephthalate (PET). More specifically, the material of cover 106 can be made of a glycol-modified polyethylene terephthalate (PETG). However it should be realized that cover 106 can be made of other types of materials that provide translucent or transparent properties including other types of plastics. Cover 106 includes a front surface 146, a back surface 148 (FIGS. 7 and 8), a plurality of tabs 150 and at least one through slot or aperture 151 that extends from the front surface 146 to the back surface 148. In the embodiment illustrated in FIGS. 1-10, cover 106 includes four tabs 150, where each tab is located as an extension on one of the four edges or sides of cover 106. In particular, each tab 150 extends along a portion of each side of cover 106. It should be realized that in other embodiments, cover 106 can include only two tabs located on opposing edges or sides from each other.

As illustrated in FIGS. 1 and 4-10, each of tabs 150 are formed integrally with cover 106 and include the same front surface 146 and back surface 148. Three of the tabs 150 are bent such that the back surface 148 of the tab folds over to face the back surface 148 of cover 106. The distance between the back surface 148 of the cover 106 and the back surface 148 of the tab 150 is great enough to accommodate and house a thickness of both front face 103 of base 102 and sign 104. FIGS. 7-10 illustrate this in detail. One of the tabs 150, however, bends only at a substantially 90 degree or substantially perpendicular angle from the front surface 146 of the cover 106.

With reference back to FIG. 1, front face 103 of base 102 and sign 104 are received by cover 106 as indicated by the directional arrow. The thicknesses of front face 103 and sign 104 slide between the back surface 148 of cover 106 and the back surface 148 of three of the bent tabs 150. The fourth tab 150 is not fully bent over such that cover 106 is open to receiving front face 103 and sign 104.

Each through slot 151 of cover 106 corresponds with the location and alignment of each through slot 114 of base 102 and each through slot 138 of sign 104. In particular, cover 106 includes nine through slots 151 centered in a 3×3 matrix. Each through slot 151 is in alignment with two other through slots 151 in a horizontal direction and in alignment with two other through slots 151 in a vertical direction. Each through slot 151 includes an elongated opening having a width 152 large enough to accommodate the fabric sample width and a height 154 large enough to accommodate the fabric sample thickness. More specifically, each through slot 154 of cover 106 is substantially equivalent to each through slot 114 of base 102 and each through slot 138 of sign 104 including width 152 being substantially similar to widths 132 and 142 and heights 134 and 144 being substantially similar to height 154.

Figure 2:
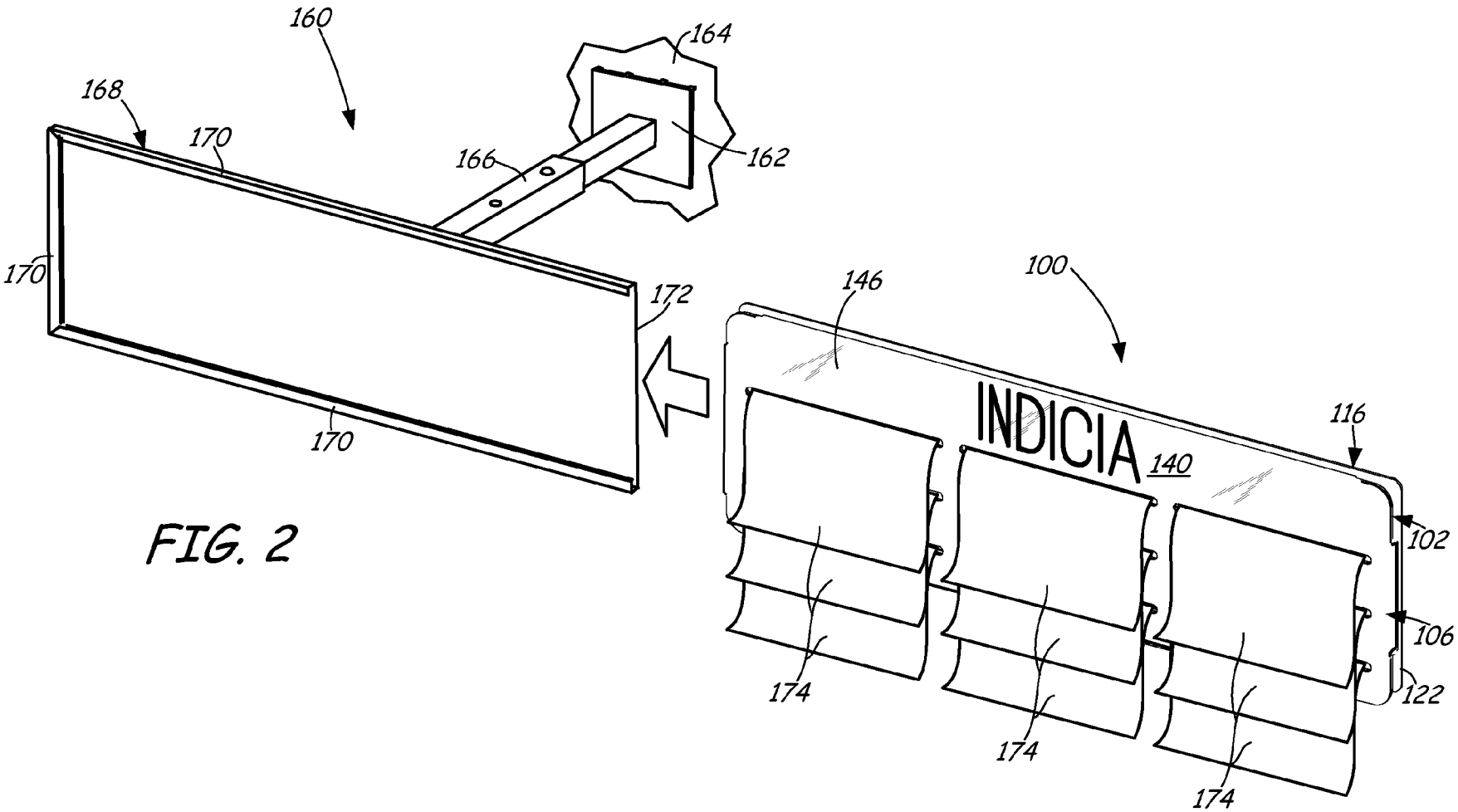
FIG. 2 is a perspective view of the assembled swatch and sign holder of FIG. 1 illustrating its engagement with a display structure.
Figure 3:
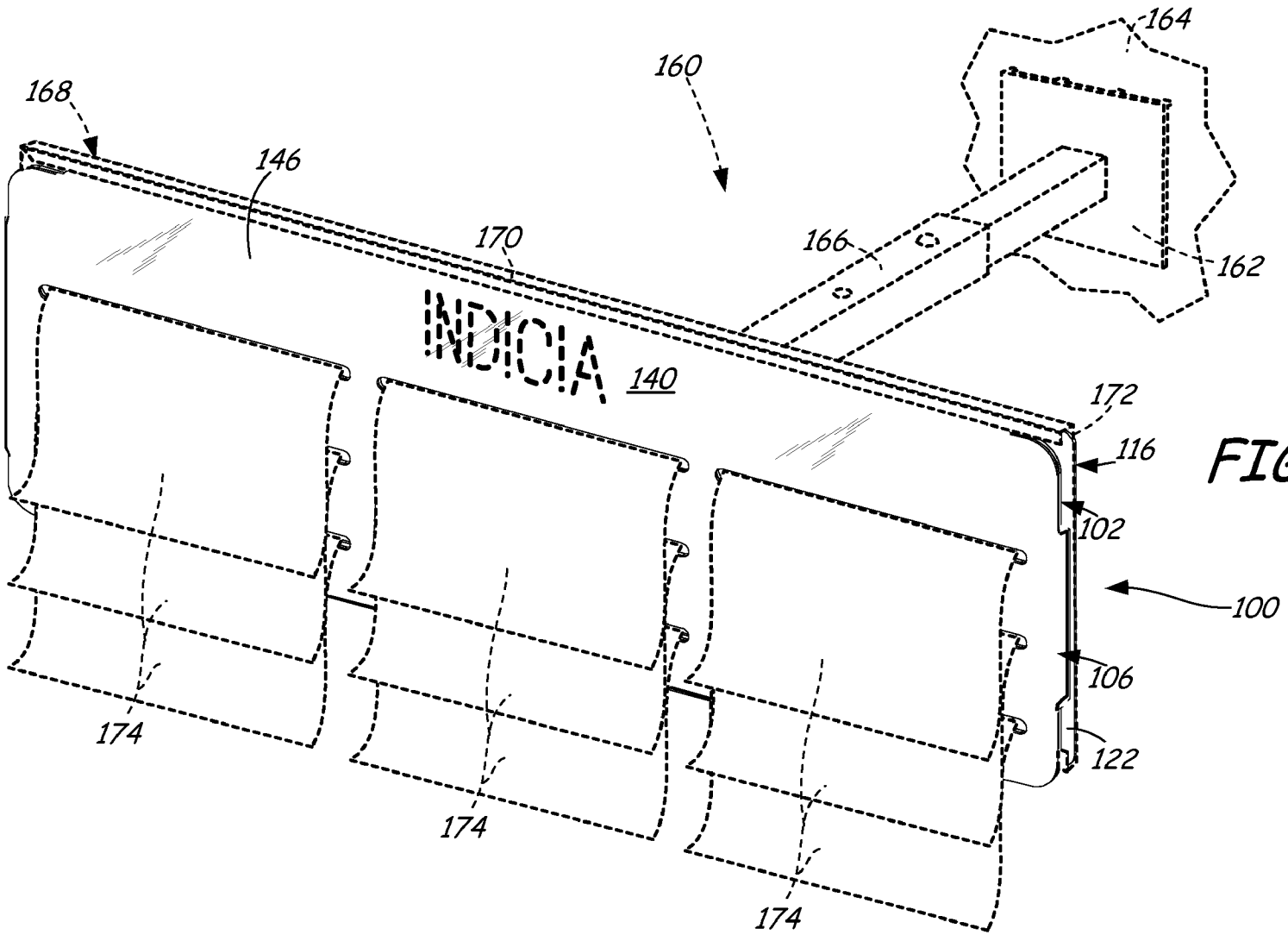
FIG. 3 illustrates a perspective view of the swatch and sign holder illustrated in FIG. 2 as engaged with the display structure.
Figure 4:
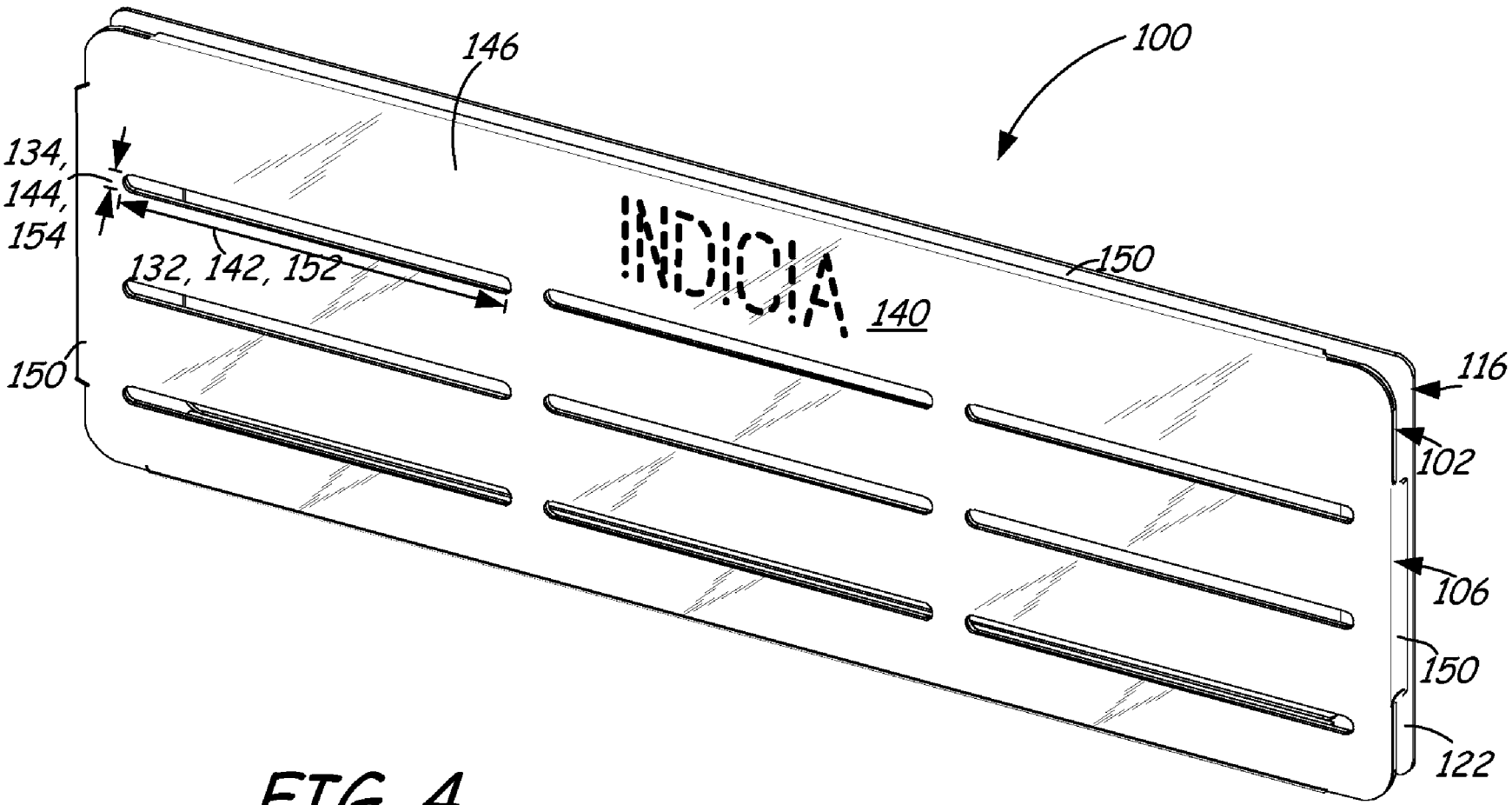
FIG. 4 illustrates a perspective view of the swatch and sign holder illustrated in FIG. 3.
Figure 5:
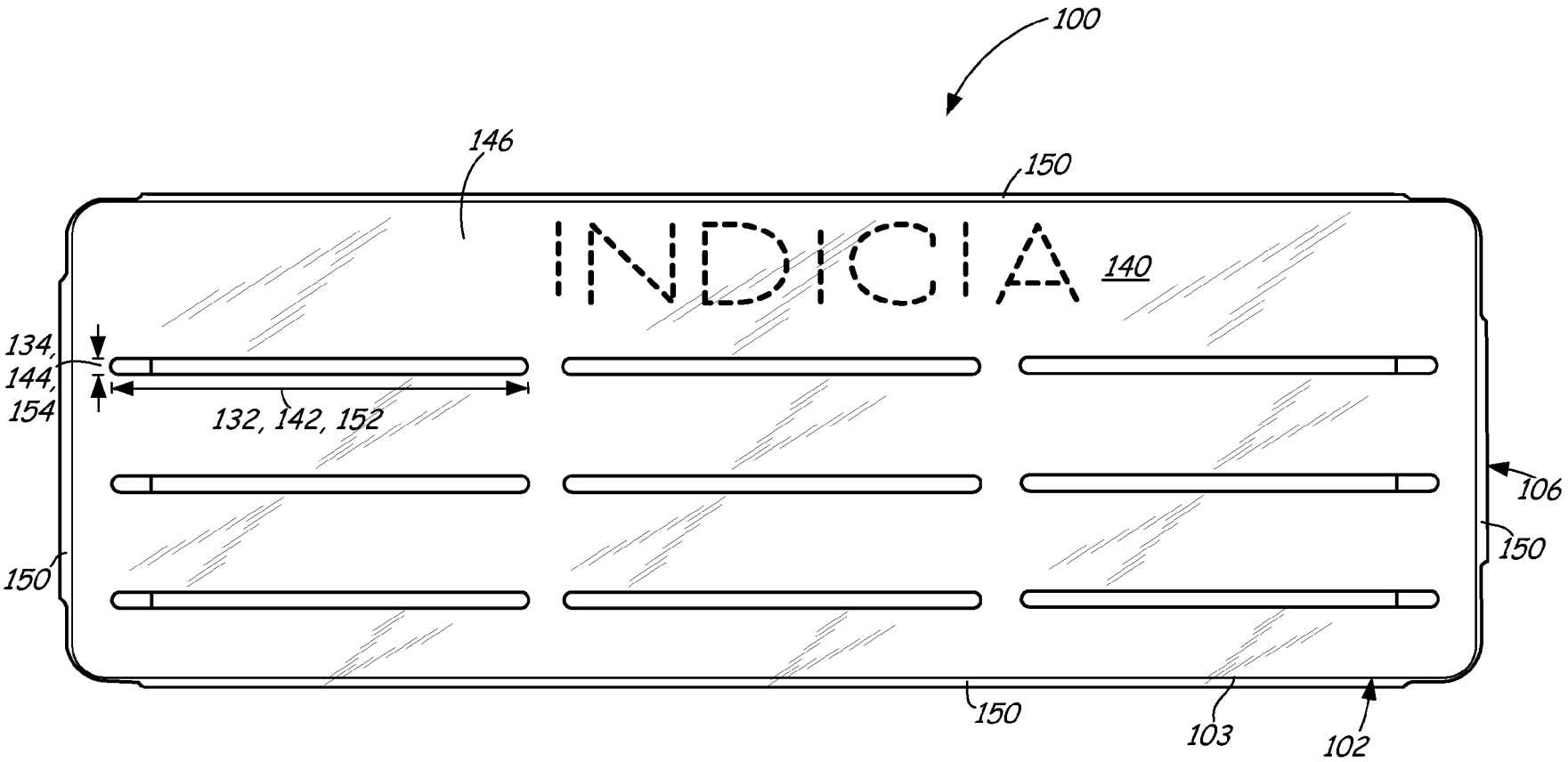
FIG. 5 illustrates a front view of the swatch and sign holder illustrated in FIG. 3.

Upon cover 106 receiving front face 103 and sign 104, swatch and sign holder 100 is fully assembled as illustrated in FIGS. 2-10. FIGS. 2 and 3 illustrate perspective views of assembled swatch and sign holder 100 and an exemplary display structure or fixture 160. Display structure 160 includes a base 162 coupled to a peg board 164, an adjustable arm 166 coupled to the base 162 and a retainer portion 168 coupled to the distal end of the adjustable arm 166. Retainer portion 168 includes three sides 170 of flanges and an open side 172. As illustrated in FIG. 2, open side 172 of retainer portion 168 receives swatch and sign holder 100 as indicated by the directional arrow. In particular and as illustrated in FIG. 3 embodiment, the three sides 170 of flanges of retainer portion 168 receive and retain frame 122 of receiver 116 of base 102. In other embodiments, retainer portion 168 can include only two flanges located on opposing edges or sides from each other. Display structure 160 illustrates exemplary hardware that can be used to support retainer portion 168 and it should be realized that other types of hardware can be used. For example, rather than retainer portion 168 being mounted to a peg board using adjustable arm 166, retainer portion 168 can be mounted to the front of a shelf using an alternative bracket and a fastener.

As also illustrated in FIGS. 2 and 3, a swatch 174 is positioned or held within each of the through slots 114, 138 and 151 of the assembled swatch and sign holder 100. As illustrated, one end of the swatches 174 are free ends and the other end (hidden from view) of the swatches 174 are fixed ends. Although not particularly illustrated, the fixed ends of swatches 174 can include a piece of the other of the mating hook and/or loop material from the hook and/or loop pieces 108. Not only are swatches 174 held by through slots 114, 138 and 151, but they are also secured to back surface 112 of front face 103 using hook and/or loop material. Therefore, spacers 118 and 120 of receiver 116 allow front surface 110 of front face 103, sign 104, cover 106 and swatches 174 to protrude from retainer portion 168 for display.

Figure 11:
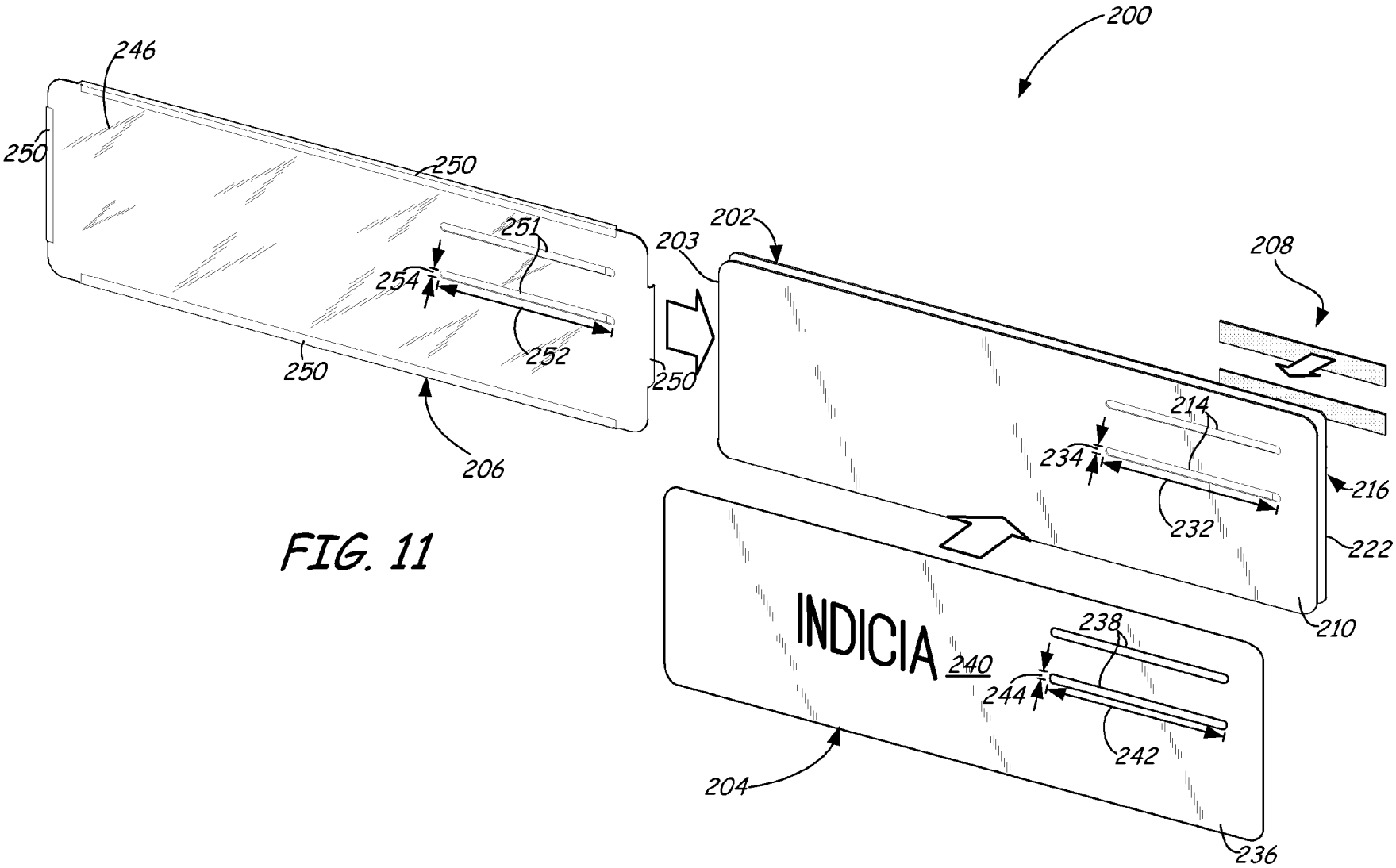
FIG. 11 illustrates an exploded perspective view of a swatch and sign holder under another embodiment.

FIGS. 11-20 illustrate various views of a swatch and sign holder 200 under another embodiment. FIG. 11 is an exploded perspective view of swatch and sign holder 200, while FIGS. 12-20 illustrate swatch and sign holder 200 assembled. More specifically, FIGS. 11-14 illustrate perspective views of swatch and sign holder 200, while FIGS. 16-20 illustrate elevation views of swatch and sign holder 200. Swatch and sign holder 200 includes a base or fabric swatch display 202, a sign or substrate 204, a cover or cap 206 and at least one hook and/or loop piece 208. Base 202, sign 204, cover 206 and at least one hook and/or loop piece 208 can be made of the same types of materials as discussed above in regards to the swatch and sign holder 100.

Figure 16:
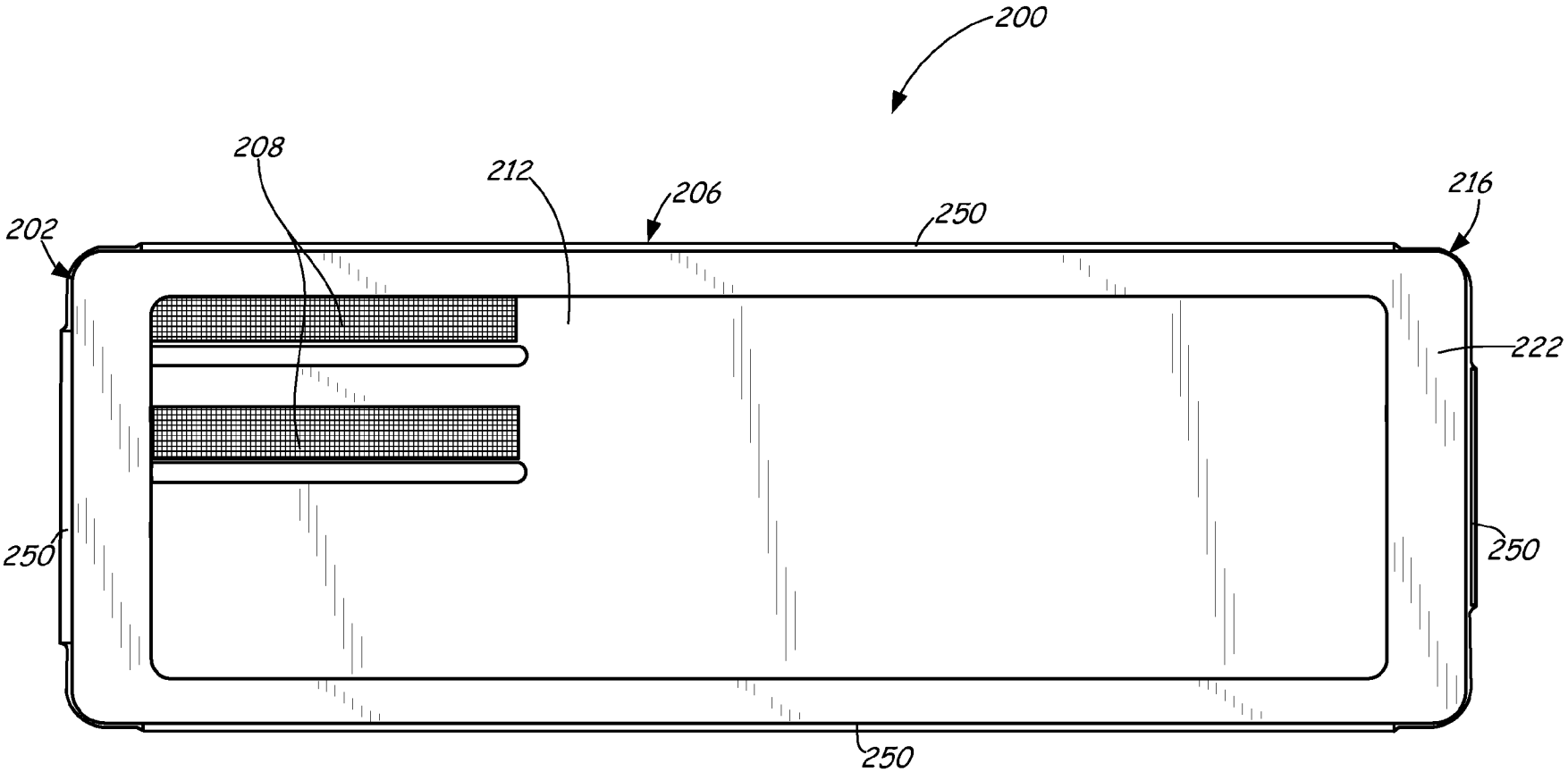
FIG. 16 illustrates a back view of the swatch and sign holder illustrated in FIG. 13.
Figure 17:
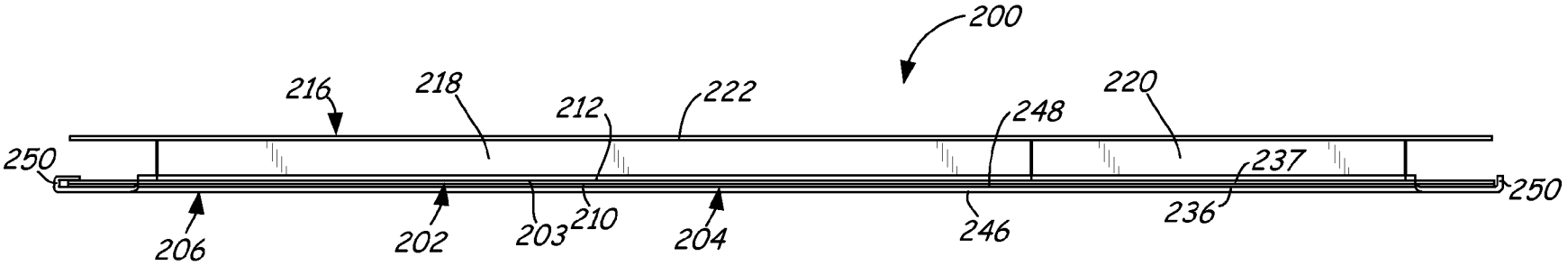
FIG. 17 illustrates a top view of the swatch and sign holder illustrated in FIG. 13.
Figure 18:
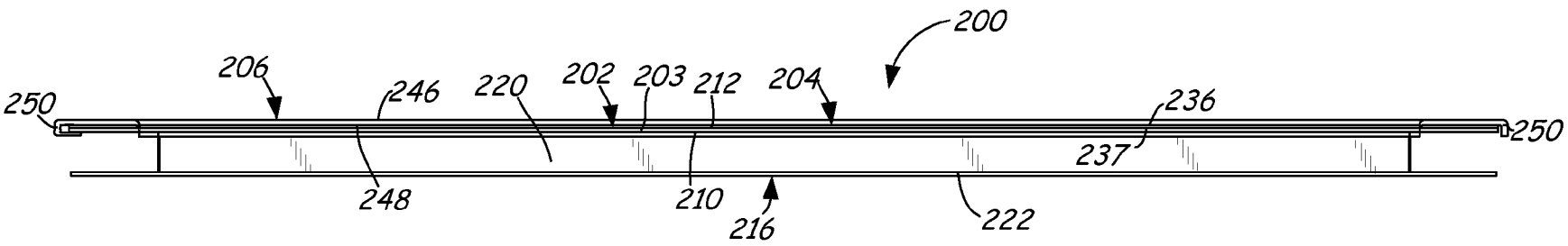
FIG. 18 illustrates a bottom view of the swatch and sign holder illustrated in FIG. 13.
Figure 19:
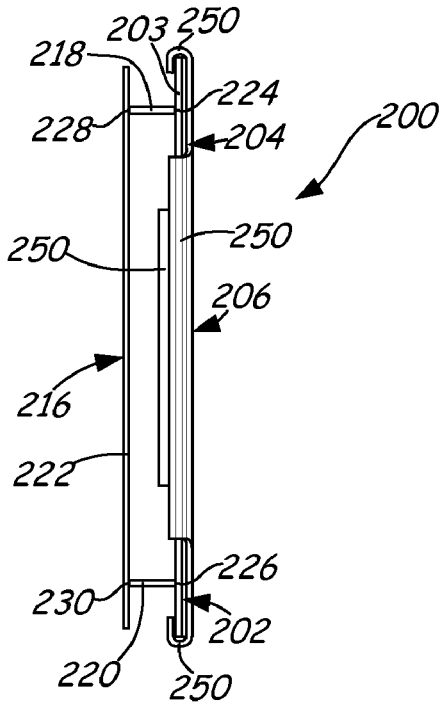
FIG. 19 illustrates a left side view of the swatch and sign holder illustrated in FIG. 13.
Figure 20:
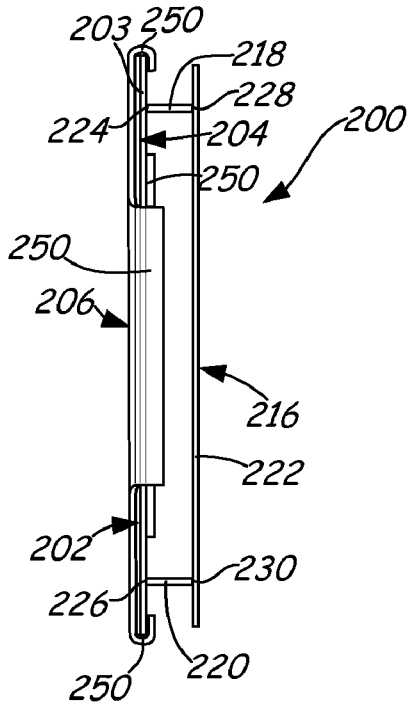
FIG. 20 illustrates a right side view of the swatch and sign holder illustrated in FIG. 13.

Base 202 includes a front surface 210, a back surface 212 (FIGS. 16-18) and at least one through slot or aperture 214 that extends from the front surface 210 to the back surface 212. Base 202 also includes a receiver 216. As illustrated in FIGS. 11 and 16 and similar to the above-described embodiment, the at least one hook and/or loop piece 208 is mounted or attached to the back surface 212 of front face 203 and is indicated in cross-hatch. Similar to the above embodiment, the location of the at least one hook and/or loop piece 208 can be above or below each through slot 214.

Receiver 216 includes a pair of spacers 218 and 220 (FIGS. 17-20) and a frame 222. First edges 224 and 226 (FIGS. 19 and 20) of the pair of spacers 218 and 220 are mounted or adhered to back surface 212 of front face 203 while opposing sides 228 and 230 couple to frame 222. For example, spacers 218 and 220 can be separate components from frame 222 such that sides 228 and 230 are second edges. In the alternative, spacers 218 and 220 can be integrally formed with frame 222. As illustrated in FIGS. 17-20, spacer 218 is located above spacer 220 and extends along front face 203 and frame 222 a distance that is less than a distance spacer 220 extends along front face 203 and frame 222. However, it should be realized that spacers 218 and 220 can extend any select distance including having substantially equivalent distances.

Base 202 includes two through slots 214. The two through slots 214 are in alignment with each other in a vertical direction. In other words, one of the slots 214 is located above the other of the slots 214. Both slots 214 generally occupy a top right corner of the front surface 210 and include elongated openings having widths 232 large enough to accommodate a fabric sample width and heights 234 large enough to accommodate a fabric sample thickness. More specifically, each of through slots 214 includes width 232 being greater than height 234.

Sign or substrate 204 includes a front surface 236, a back surface 237 (FIGS. 17 and 18), at least one through slot 238 and indicia 240. Each through slot 238 extends from the front surface 236 to the back surface 237. The back surface of sign 104 is configured to engage into contact with the front surface 210 of front face 203 as indicated by the directional arrow in FIG. 11. Each through slot 238 of sign 204 corresponds with the location and alignment of each through slot 214 of front face 203. In particular, sign 204 includes two through slots 238 in alignment with each other in a vertical direction. In other words, one of the slots 238 is located above the other of the slots 238. Both through slots 238 generally occupy a top right corner of the front surface 236 of sign 204. Each through slot 238 includes an elongated opening having a width 242 large enough to accommodate the fabric sample width and a height 244 large enough to accommodate the fabric sample thickness. More specifically, each through slot 238 of sign 204 is substantially equivalent to each through slot 214 of front face 203 including width 242 being substantially similar to width 232 and height 244 being substantially similar to height 234. Indicia 240, which can include printed images, graphics and/or text, can be located anywhere on front surface 236 of sign 204. The specific location of indicia 240 on front surface 236 as illustrated in FIGS. 11-15 is for exemplary purposes only.

Cover or cap 206 includes a front surface 246, a back surface 248 (FIGS. 17 and 18), a plurality of tabs 250 and at least one through slot or aperture 251 that extends from the front surface 246 to the back surface 248. In the embodiment illustrated in FIGS. 11-20, cover 206 includes four tabs 250, where each tab is located as extensions on each of the four edges or sides of cover 206. In particular, each tab 250 extends along a portion of each side of cover 206. It should be realized that in other embodiments, cover 206 can include only two tabs located on opposing edges or sides from each other.

As illustrated in FIGS. 11 and 14-20, each of tabs 250 are formed integrally with cover 206 and include the same front surface 246 and back surface 248. Three of the tabs 250 are bent such that the back surface 248 of the tab folds over to face the back surface 248 of cover 206. The distance between the back surface 248 of the cover 206 and the back surface 248 of the tab 250 is great enough to accommodate and house a thickness of both front face 203 of base 202 and sign 204. FIGS. 17-20 illustrate this in detail. One of the tabs 250, however, bends only at a substantially 90 degree or substantially perpendicular angle from the front surface 246 of the cover 206.

With reference back to FIG. 11, front face 203 and sign 204 are received by cover 206 as indicated by the directional arrow. The thicknesses of front face 203 and sign 204 slide between the back surface 248 of cover 206 and the back surface 248 of three of the bent tabs 250. The fourth tab 250 is not fully bent over such that cover 206 is open to receiving front face 203 and sign 204.

Each through slot 251 of cover 206 corresponds with the location and alignment of each through slot 214 of base 202 and each through slot 238 of sign 204. In particular, cover 206 includes two through slots 251 in alignment with each other in a vertical direction. In other words, one of the slots 251 is located above the other of the slots 251. Both through slots 251 occupy a top right corner of the front surface 246 of cover 206. Each through slot 251 includes an elongated opening having a width 252 large enough to accommodate the fabric sample width and a height 254 large enough to accommodate the fabric sample thickness. More specifically, each through slot 251 of cover 206 is substantially equivalent to each through slot 214 of base 202 and each through slot 238 of sign 204 including width 252 being substantially similar to widths 232 and 242 and heights 234 and 244 being substantially similar to height 254.

Figure 12:
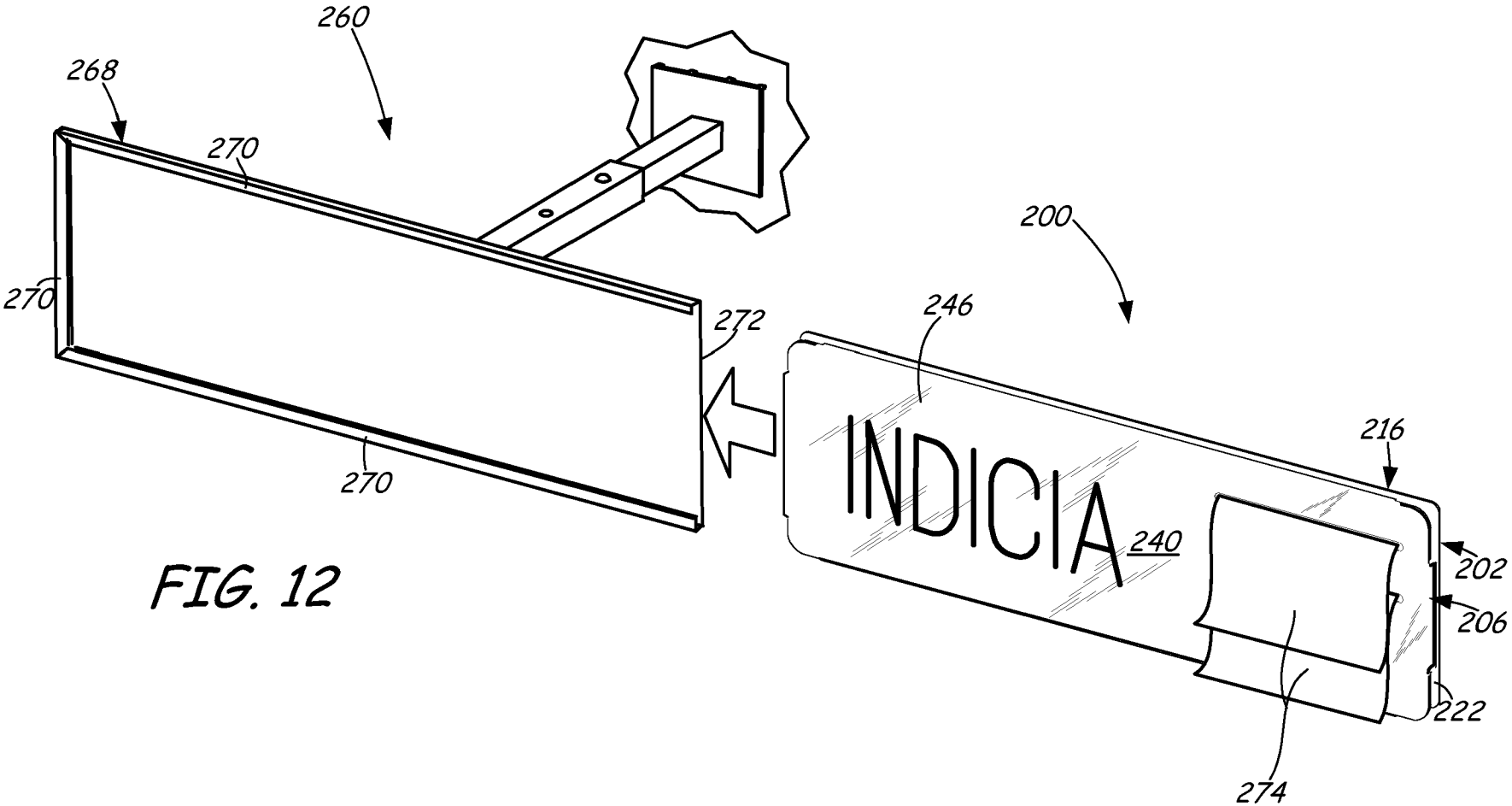
FIG. 12 is a perspective view of the assembled swatch and sign holder of FIG. 11 illustrating its engagement with a display structure.
Figure 13:
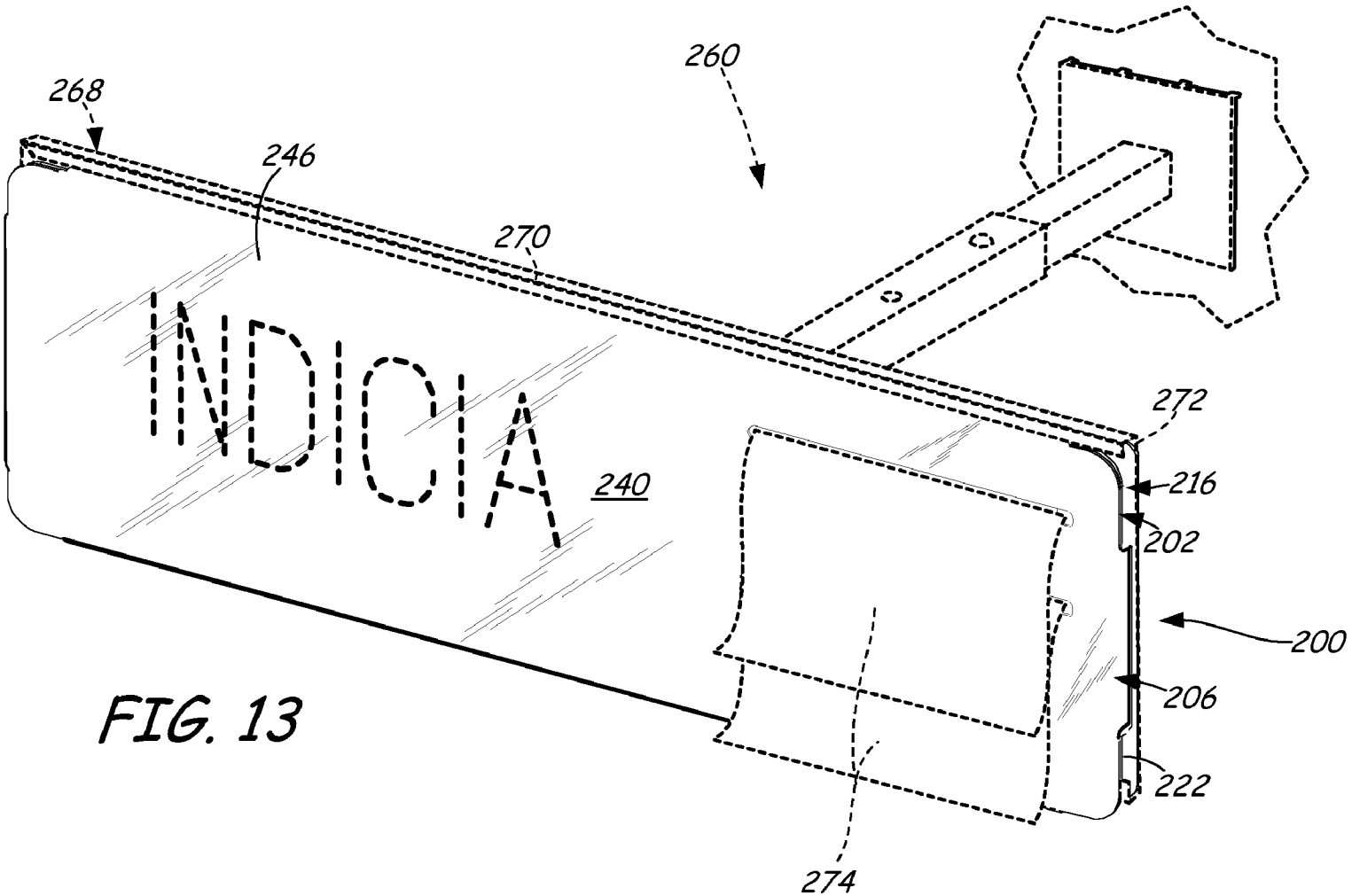
FIG. 13 illustrates a perspective view of the swatch and sign holder illustrated in FIG. 12 as engaged with the display structure.
Figure 14:
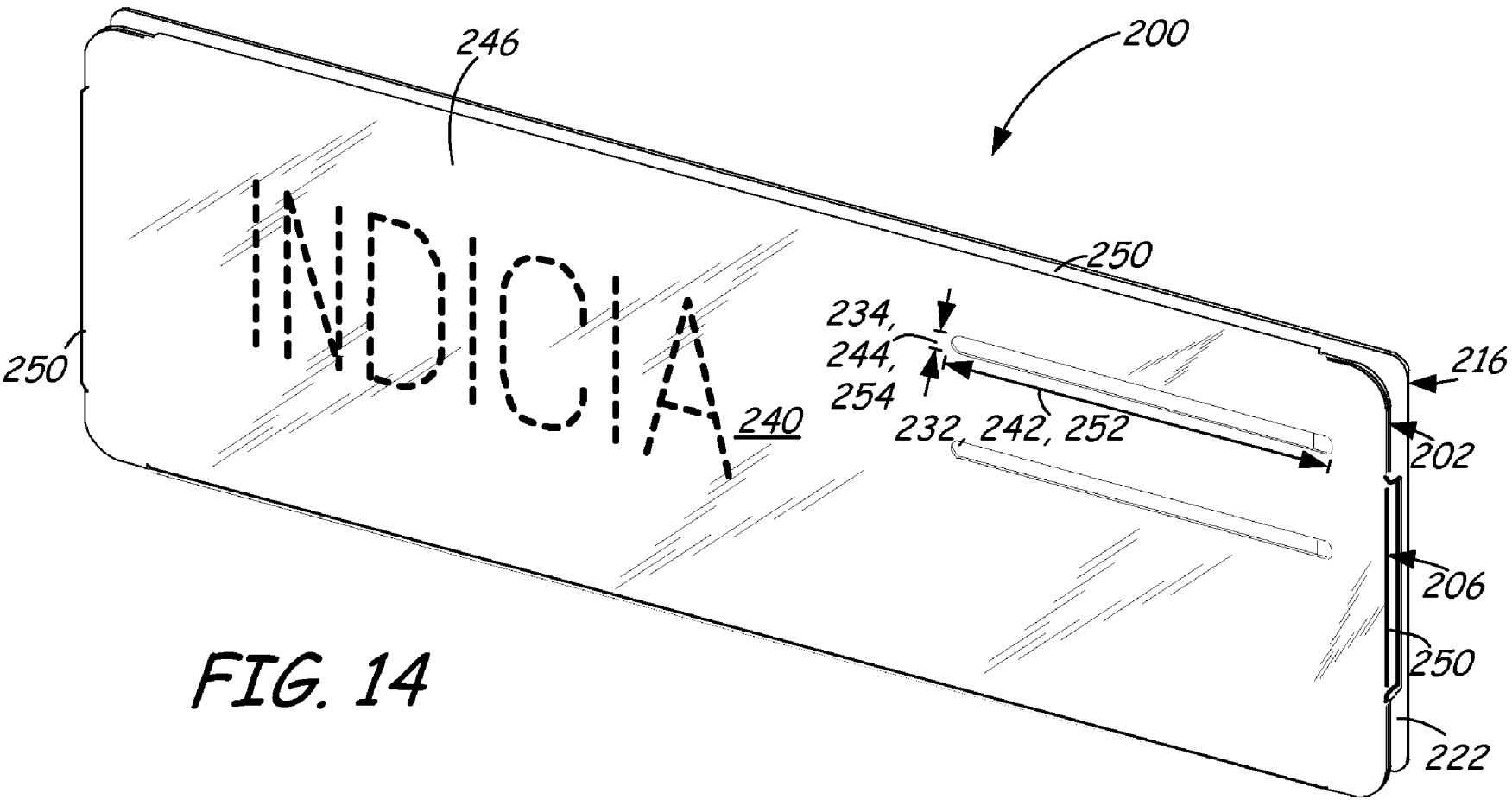
FIG. 14 illustrates a perspective view of the swatch and sign holder illustrated in FIG. 13.
Figure 15:
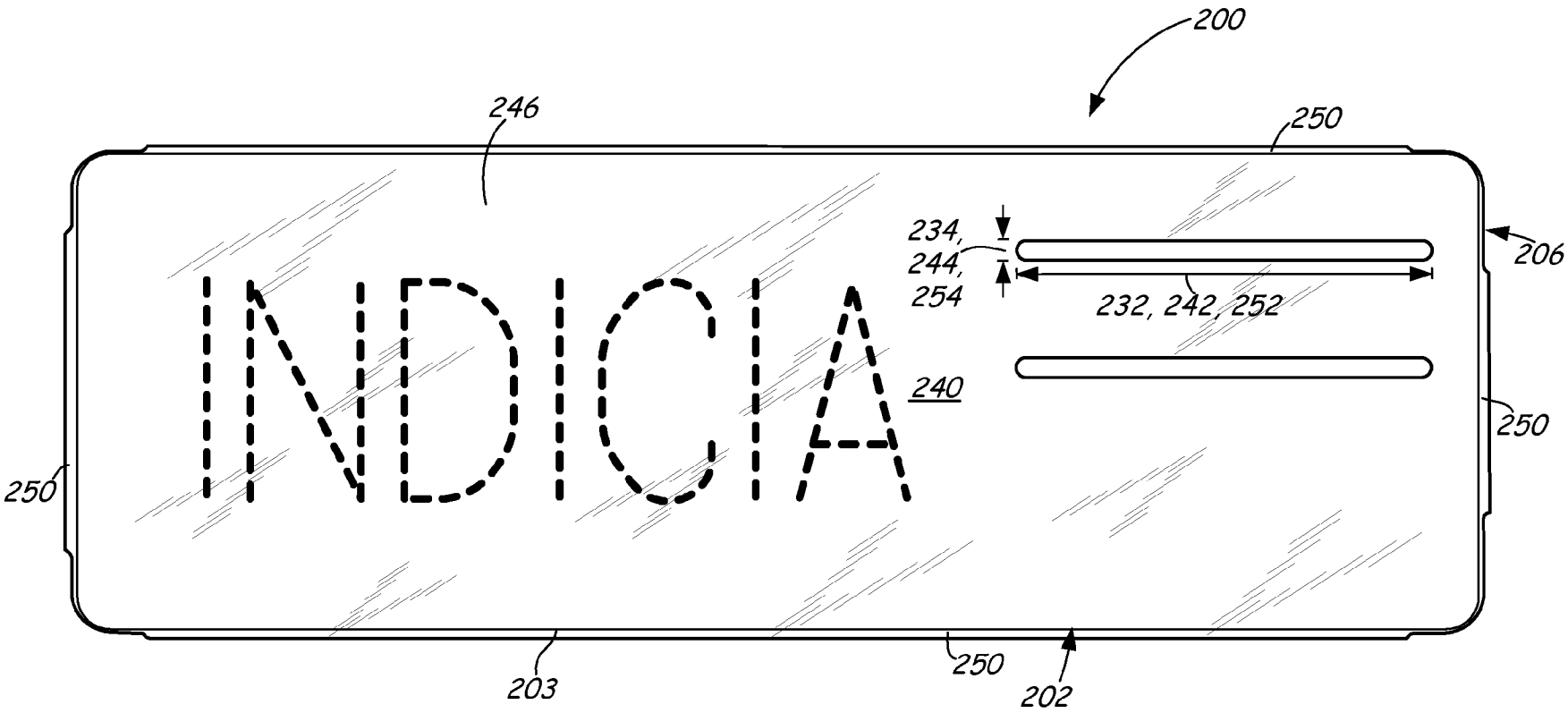
FIG. 15 illustrates a front view of the swatch and sign holder illustrated in FIG. 13.

Upon cover 206 receiving front face 203 and sign 204, swatch and sign holder 200 is fully assembled as illustrated in FIGS. 12-20. FIGS. 12 and 13 illustrate perspective views of assembled swatch and sign holder 200 and a display structure or fixture 260 similar to the display structure 160 for use with the above disclosed embodiment. As illustrated in FIG. 12, open side 272 of retainer portion 268 receives swatch and sign holder 200 as indicated by the directional arrow. In particular and as illustrated in the FIG. 13 embodiment, the three sides 270 of flanges of retainer portion 268 receive and retain frame 222 of receiver 216 of base 202. In other embodiments, retainer portion 268 can include only two flanges located on opposing edges or sides from each other. As described above, rather than retainer portion 268 being mounted to a peg board, retainer portion 268 can be mounted to the front of a shelf using an alternative bracket and a fastener.

As also illustrated in FIGS. 12 and 13, a swatch 274 is positioned or held within each of the through slots 214, 238 and 251 of the assembled swatch and sign holder 200. As illustrated, one end of the swatches 274 are free ends and the other end (hidden from view) of the swatches 274 are fixed ends. Although not particularly illustrated, the fixed ends of swatches 274 can include a piece of the other of the mating hook and/or loop material from the hook and/or loop pieces 208. Not only are swatches 274 held by through slots 214, 238 and 251, but they are also secured to back surface 212 of front face 203 using hook and/or loop material. Therefore, spacers 218 and 220 of base receiver 216 allow front surface 210 of front face 203, sign 204, cover 206 and swatches 274 to protrude from retainer portion 268 for display.

Figure 21:
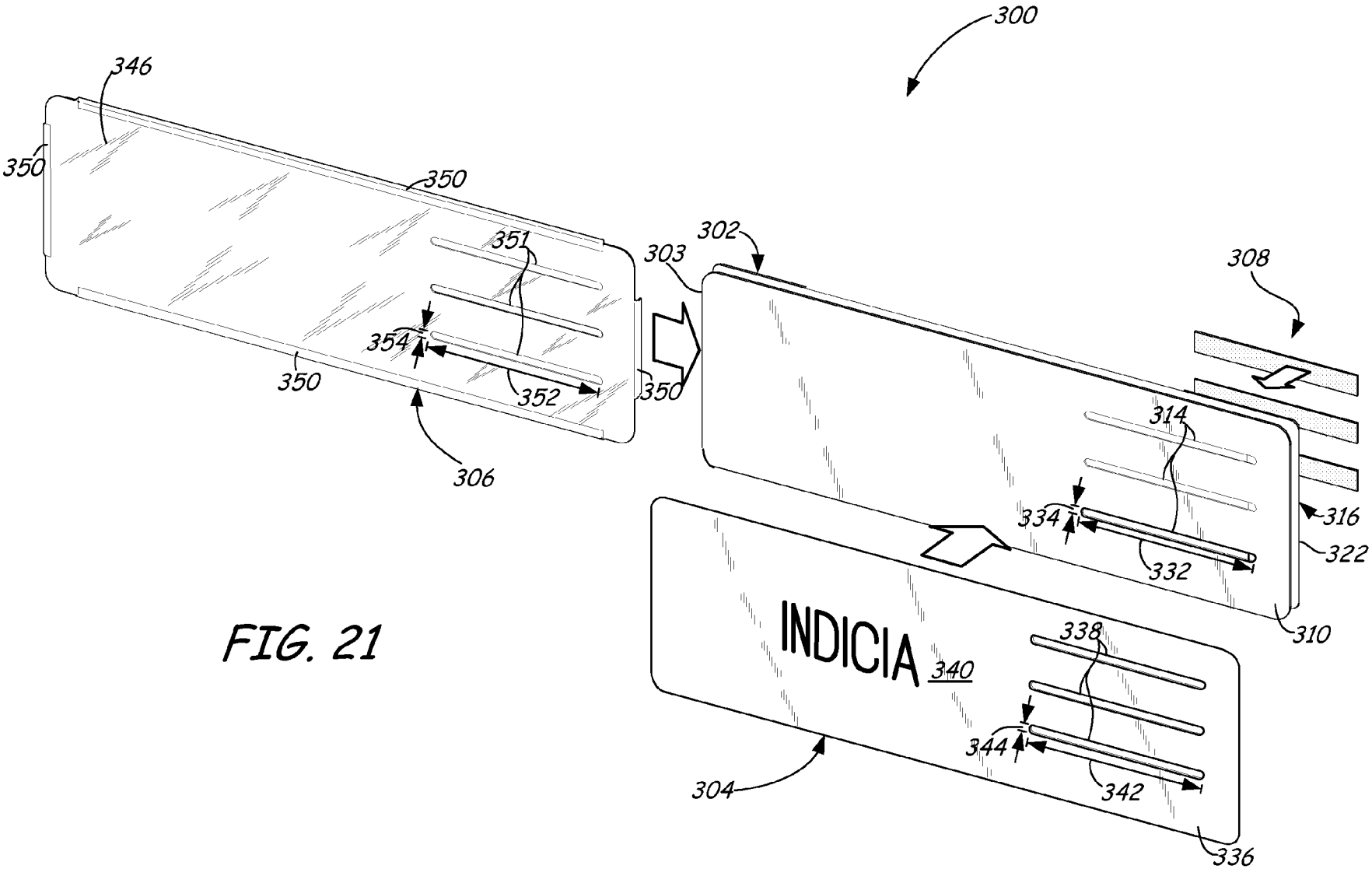
FIG. 21 illustrates an exploded perspective view of a swatch and sign holder under yet another embodiment.

FIGS. 21-30 illustrate various views of a swatch and sign holder 300 under another embodiment. FIG. 21 is an exploded perspective view of swatch and sign holder 300, while FIGS. 22-30 illustrate swatch and sign holder 300 assembled. More specifically, FIGS. 21-24 illustrate perspective views of swatch and sign holder 300, while FIGS. 25-30 illustrate elevation views of swatch and sign holder 300. Swatch and sign holder 300 includes a base or fabric swatch display 302, a sign or substrate 304, a cover or cap 306 and at least one hook and/or loop piece 308. Base 302, sign 304, cover 306 and hook and/or loop pieces 308 can be made of the same types of material as discussed above in regards to the swatch and sign holder 100.

Figure 26:
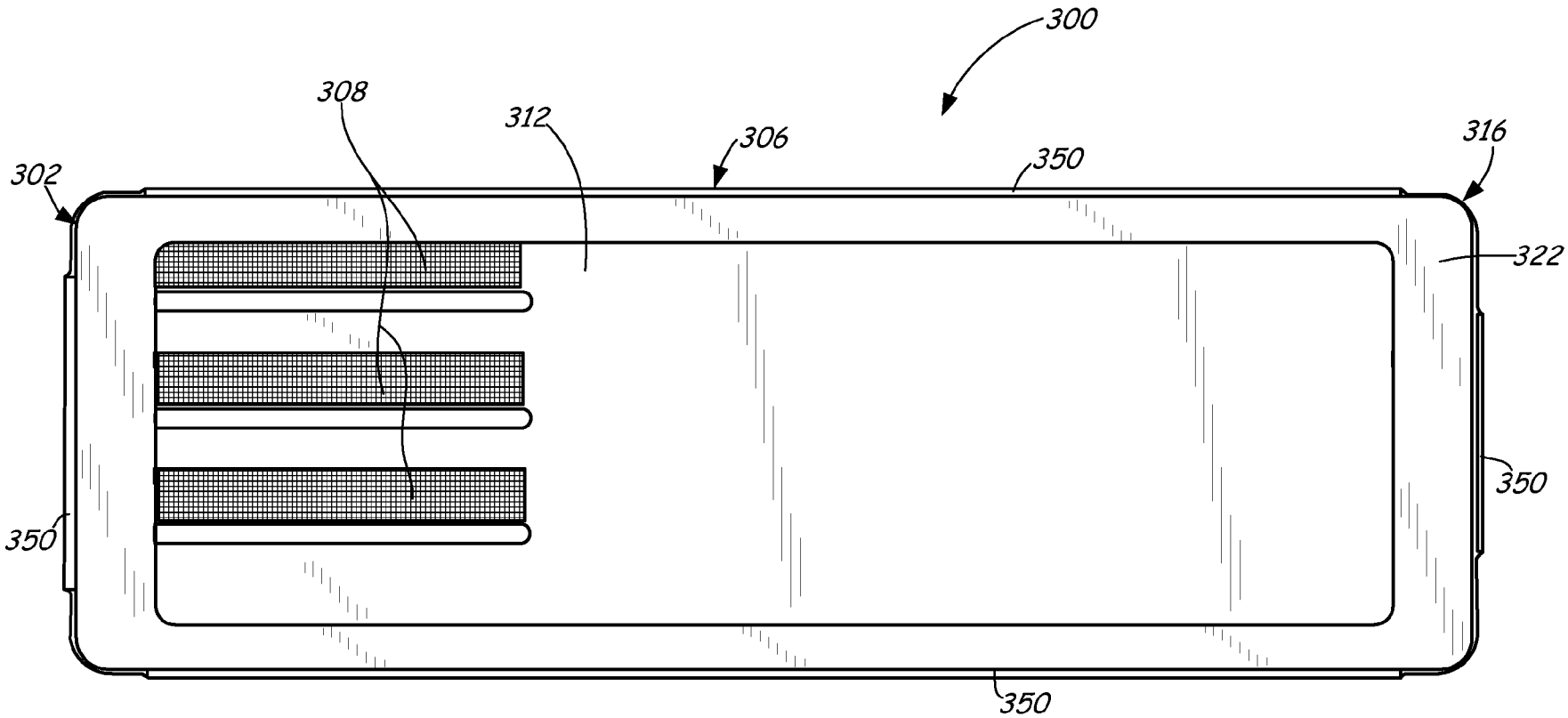
FIG. 26 illustrates a back view of the swatch and sign holder illustrated in FIG. 23.

Base 302 includes a front surface 310, a back surface 312 (FIGS. 26-28), at least one through slot or aperture 314 that extends from the front surface 310 to the back surface 312. Base 302 also includes a receiver 316. As illustrated in FIGS. 21 and 26 and similar to the above-described two embodiments, the at least one hook and/or loop piece 308 is mounted or attached to the back surface 312 of front face 303 and is indicated in cross-hatch. Similar to the above two embodiments, the location of the at least one hook and/or loop piece 308 can be above or below each through slot 314.

Figure 27:
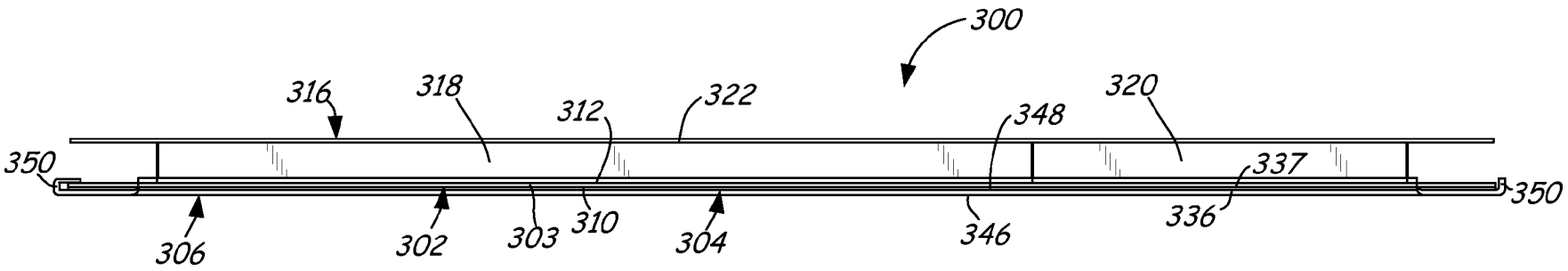
FIG. 27 illustrates a top view of the swatch and sign holder illustrated in FIG. 23.
Figure 28:
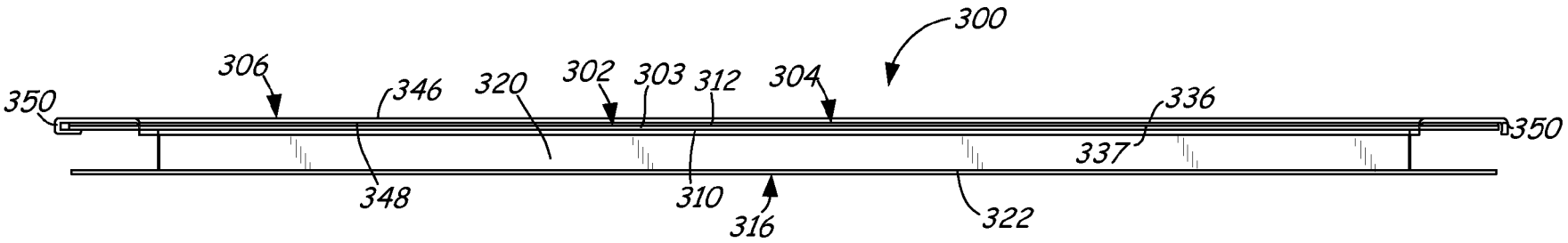
FIG. 28 illustrates a bottom view of the swatch and sign holder illustrated in FIG. 23.
Figure 29:
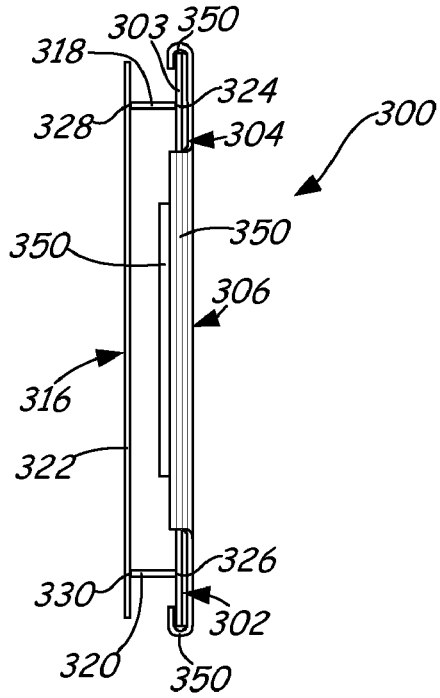
FIG. 29 illustrates a left side view of the swatch and sign holder illustrated in FIG. 23.
Figure 30:
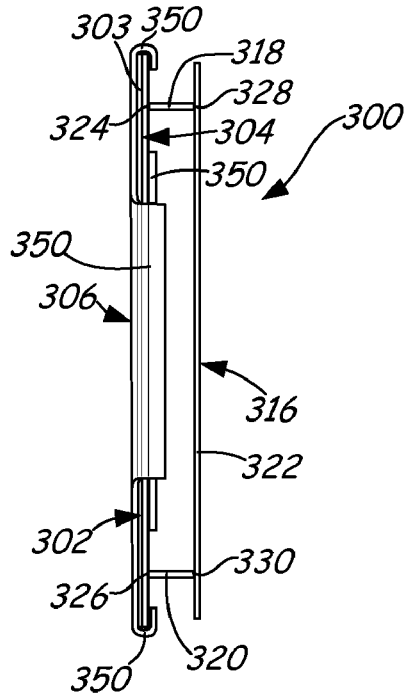
FIG. 30 illustrates a right side view of the swatch and sign holder illustrated in FIG. 23.

Receiver 316 includes a pair of spacers 318 and 320 (FIGS. 27-30) and a frame 322. First edges 324 and 326 (FIGS. 29 and 30) of the pair of spacers 318 and 320 are mounted or adhered to back surface 312 of base 302 while opposing sides 328 and 330 couple to frame 322. For example, spacers 318 and 320 can be separate components from frame 322 such that sides 328 and 330 are second edges. In the alternative, spacers 318 and 320 can be integrally formed with frame 322. As illustrated in FIGS. 27 and 28, spacer 318 is located above spacer 320 and extends along front face 303 and frame 322 a distance that is less than a distance spacer 320 extends along front face 303 and frame 322. However, it should be realized that spacers 318 and 320 can extend any select distance including having substantially equivalent distances.

Base 302 includes three through slots 314. The three through slots 314 are in alignment with each other in a vertical direction. In other words, the slots 314 are located one above the other. The three slots 314 generally occupy a top right corner of the front surface 310 and include elongated openings having widths 332 large enough to accommodate a fabric sample width and heights 334 large enough to accommodate a fabric sample thickness. More specifically, each of through slots 314 includes width 332 being greater than height 334.

Sign or substrate 304 includes a front surface 336, a back surface 337 (FIGS. 27 and 28), at least one through slot 338 and indicia 340. Each through slot 338 extends from the front surface 336 to the back surface 337. The back surface of sign 304 is configured to engage into contact with the front surface 310 of front face 303 as indicated by the directional arrow in FIG. 21. Each through slot 338 of sign 304 corresponds with the location and alignment of each through slot 314 of front face 303. In particular, sign 304 includes three through slots 338 in alignment with each other in a vertical direction. In other words, the slots 338 are located one above the other. The through slots 338 generally occupy a top right corner of the front surface 336 of sign 304. Each through slot 338 includes an elongated opening having a width 342 large enough to accommodate the fabric sample width and a height 344 large enough to accommodate the fabric sample thickness. More specifically, each through slot 338 of sign 304 is substantially equivalent to each through slot 314 of front face 303 including width 342 being substantially similar to width 332 and height 344 being substantially similar to height 334. Indicia 340, which can include printed images, graphics and/or text, can be located anywhere on front surface 336 of sign 304. The specific location of indicia 340 on front surface 336 as illustrated in FIGS. 21-25 is for exemplary purposes only.

Cover or cap 306 includes a front surface 346, a back surface 348 (FIGS. 27 and 28), a plurality of tabs 350 and at least one through slot or aperture 351 that extends from the front surface 346 to the back surfaces 348. In the embodiment illustrated in FIGS. 21-30, cover 306 includes four tabs 350, where each tab is located as extensions on each of the four edges or sides of cover 306. In particular, each tab 350 extends along a portion of each side of cover 306. It should be realized that in other embodiments, cover 306 can include only two tabs located on opposing edges or sides from each other.

As illustrated in FIGS. 21 and 24-30, each of tabs 350 are formed integrally with cover 306 and include the same front surface 346 and back surface 348. Three of the tabs 350 are bent such that the back surface 348 of the tab folds over to face the back surface 348 of cover 306. The distance between the back surface 348 of the cover 306 and the back surface 348 of the tab 350 is great enough to accommodate and house a thickness of both front face 303 of base 302 and sign 304. FIGS. 27-30 illustrate this in detail. One of the tabs 350, however, bends only at a substantially 90 degree or substantially perpendicular angle from the front surface 346 of the cover 306.

With reference back to FIG. 21, base 302 and sign 304 are received by cover 306 as illustrated by the directional arrow. The thicknesses of base 302 and sign 304 slide between the back surface 348 of cover 306 and the back surface 348 of three of the bent tabs 350. The fourth tab 350 is not fully bent over such that cover 306 can receive base 302 and sign 304.

Each through slot 351 of cover 306 corresponds with the location and alignment of each through slot 314 of base piece 302 and each through slot 338 of sign 304. In particular, cover 306 includes three through slots 351 in alignment with each other in a vertical direction. In other words, the slots 351 are located one above the other. Through slots 351 occupy a top right corner of the front surface 346 of cover 306. Each through slot 351 includes an elongated opening having a width 352 large enough to accommodate the fabric sample width and a height 354 large enough to accommodate the fabric sample thickness. More specifically, each through slot 351 of cover 306 is substantially equivalent to each through slot 314 of base 302 and each through slot 338 of sign 304 including width 352 being substantially similar to widths 332 and 342 and heights 334 and 344 being substantially similar to height 354.

Figure 22:
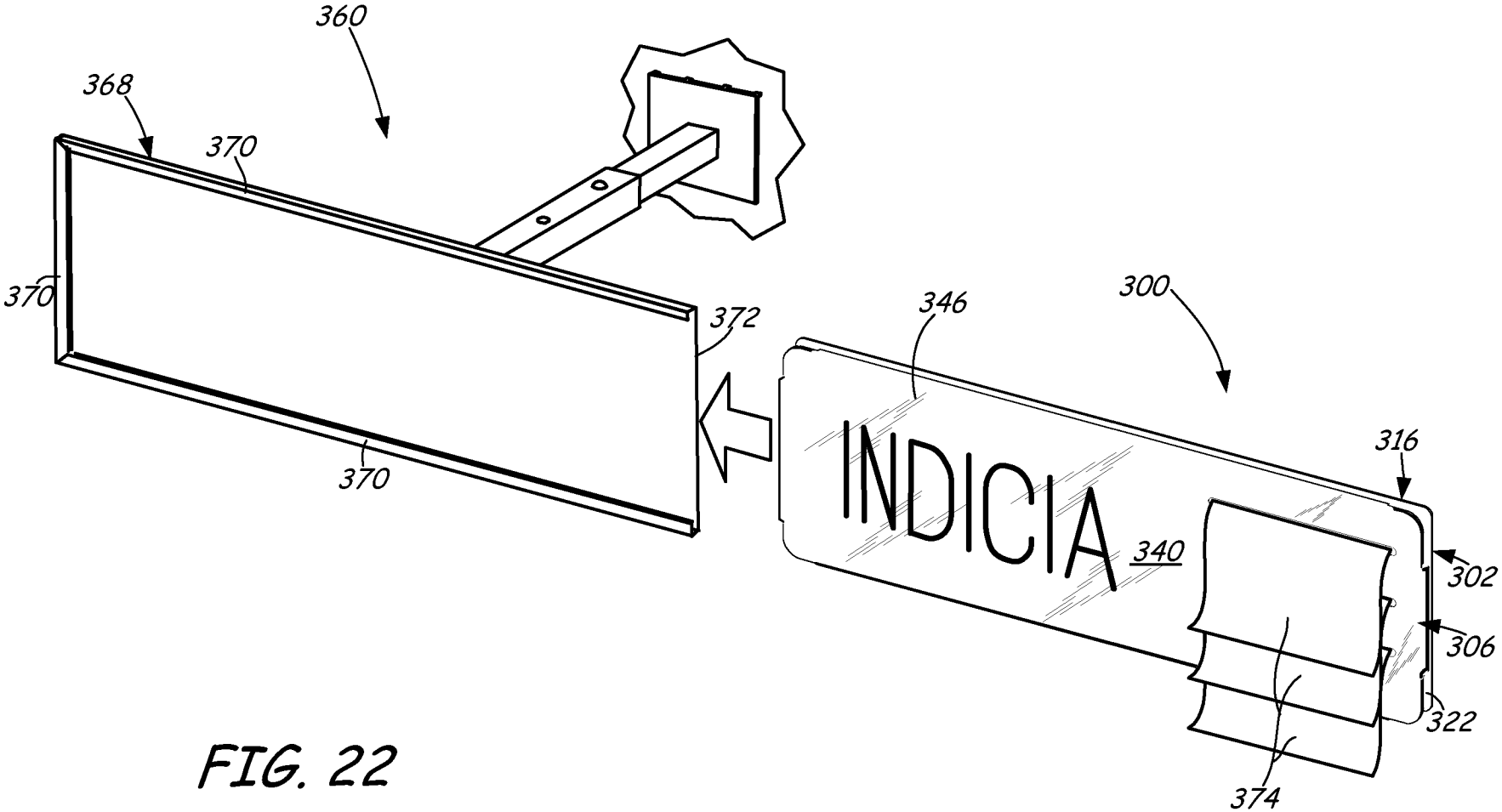
FIG. 22 is a perspective view of the assembled swatch and sign holder of FIG. 21 illustrating its engagement with a display structure.
Figure 23:
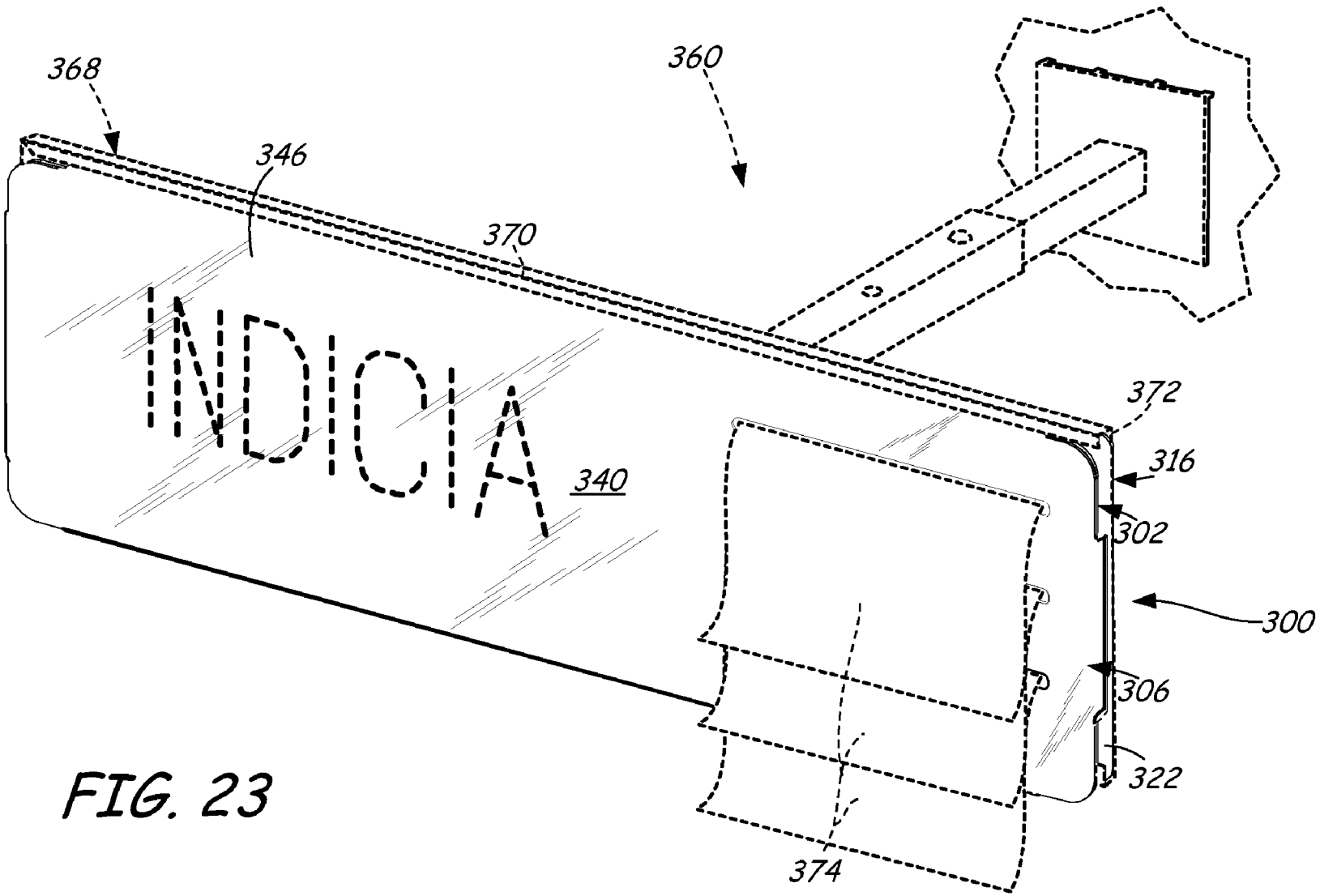
FIG. 23 illustrates a perspective view of the swatch and sign holder illustrated in FIG. 22 as engaged with the display structure.
Figure 24:
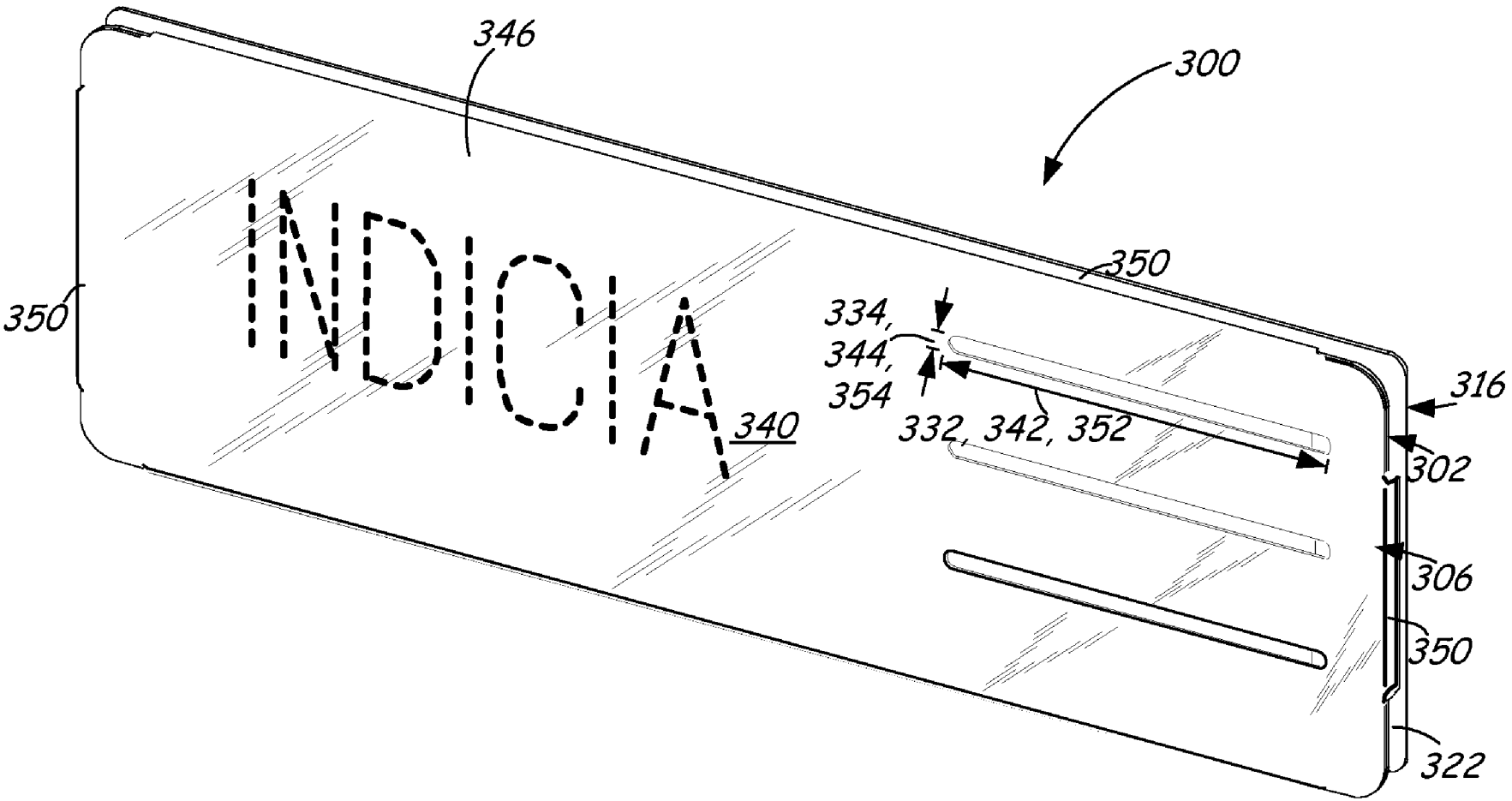
FIG. 24 illustrates a perspective view of the swatch and sign holder illustrated in FIG. 23.
Figure 25:
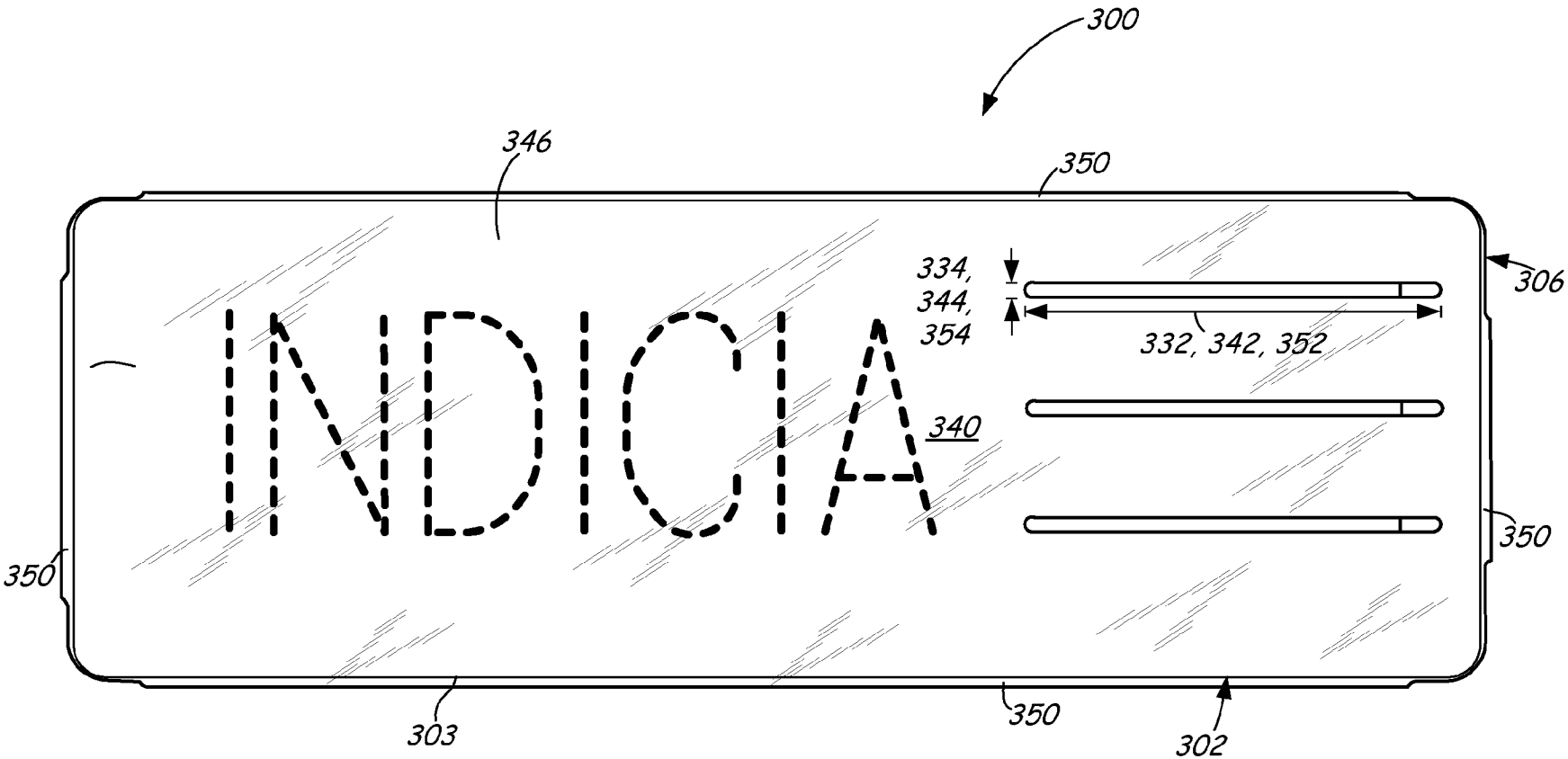
FIG. 25 illustrates a front view of the swatch and sign holder illustrated in FIG. 23.

Upon cover 306 receiving front face 303 and sign 304, swatch and sign holder 300 is fully assembled as illustrated in FIGS. 22-30. FIGS. 22 and 23 illustrate perspective views of assembled swatch and sign holder 300 and a display structure or fixture 360 similar to the display structure 160 and 260 for use with the above disclosed embodiments. As illustrated in FIG. 22, open side 372 of retainer portion 368 receives swatch and sign holder 300 as indicated by the directional arrow. In particular and as illustrated in the FIG. 23 embodiment, the three sides of flanges 370 of retainer portion 368 receive and retain frame 322 of receiver 316 of base 302. In other embodiments, retainer portion 368 can include only two flanges located on opposing edges or sides from each other. As described above, rather than retainer portion 368 being mounted to a peg board, retainer portion 368 can be mounted to the front of a shelf using an alternative bracket and a fastener.

As also illustrated in FIGS. 22 and 23, a swatch 374 is placed within each of the through slots 314, 338 and 351 of the assembled swatch and sign holder 300. As illustrated, one end of the swatches 374 are free ends and the other end (hidden from view) of the swatches 374 are fixed ends. Although not particularly illustrated, the fixed ends of swatches 374 can include a piece of the other of the mating hook and/or loop material from the hook and/or loop pieces 308. Not only are swatches 374 held by through slots 314, 338 and 351, but they are also secured to back surface 312 of front face 303 using hook and/or loop material. Therefore, spacers 318 and 320 of base receiver 316 allow front surface 310 of front face 303, sign 304, cover 306 and swatches 374 to protrude from retainer portion 368 for display.

Although the present invention has been described with reference to preferred embodiments, workers skilled in the art will recognize that changes may be made in form and detail without departing from the spirit and scope of the invention. For example, other embodiments of a swatch and sigh holder can include any number of through slots including a single through slot located on the swatch and sign holder in a variety of different locations and be of a variety of different sizes as long as the through slots in the base, the sign and the cover are all in corresponding number and alignment with each other.

What is claimed is:

1. A swatch and sign holder comprising:

a base including a front face having a front surface, a back surface, and at least one through slot extending from the front surface to the back surface, wherein the base further comprises a receiver, the receiver including at least a pair of spacers and a frame mounted to the back surface of the front face;

a sign including a front surface, a back surface, at least one through slot extending from the front surface to the back surface and indicia printed on the front surface of the sign;

a cover configured to secure the sign to the front face of the base;

wherein the sign is positioned between the front surface of the front face and the cover; and wherein each through slot of the front face and each through slot of the sign align with each other to receive a fabric swatch.

2. The swatch and sign holder of claim 1, wherein the pair of spacers couple to and extend along portions of the front face and the frame for a substantially equivalent distance.

3. The swatch and sign holder of claim 1, wherein the pair of spacers comprise a first spacer that extends a first distance along portions of the front face and the frame and a second spacer that extends a second distance along portions of the front face and the frame, the second distance being greater than the first distance.

4. The swatch and sign holder of claim 1, wherein the frame is configured for insertion into a display structure such that the pair of spacers allow the front face, the sign and the cover to protrude outwardly from the display structure.

5. The swatch and sign holder of claim 1, wherein the cover comprises a front surface, a back surface, at least a first and a second integral tab extending along at least two opposing sides of the cover and at least one through slot extending from the front surface to the back surface, each of the first and second integral tabs being bent along the sides of the cover such that the back surface of each tab faces the back surface of the cover.

6. The swatch and sign holder of claim 5, wherein each through slot of the cover aligns with each through slot of the front face and each through slot of the sign to receive the fabric swatch.

7. The swatch and sign holder of claim 5, wherein each through slot of the front face, each through slot of the sign and each through slot of the cover comprises a width and a height, the width being greater than the height.

8. The swatch and sign holder of claim 1, further comprising a swatch held within each through slot of the front face and each through slot of the sign.

9. The swatch and sign holder of claim 8, further comprising a plurality of hook or loop pieces mounted to the back surface of the front face, the plurality of hook or loop pieces constructed to secure the swatch within each through slot of the front face and each through slot of the sign.

10. A display structure comprising:

a retainer portion coupled to a distal end of an arm;

a swatch and sign holder comprising:

a fabric swatch display including a front face having a front surface, a back surface and at least one aperture extending from the front surface to the back surface, the fabric swatch display further including a receiver having at least a pair of spacers and a frame that are mounted to the back surface of the front face;

a substrate including a front surface, a back surface, at least one aperture extending from the front surface to the back surface and indicia printed on the front surface of the substrate, the back surface of the substrate engaging into contact with the front surface of the front face;

a cap configured to secure the substrate to the front face of the fabric swatch display;

wherein each aperture of the front face and each aperture of the substrate align with each other to receive a fabric swatch; and wherein the retainer portion receives portions of the frame of the fabric swatch display such that the front face, the substrate and the cover protrude outwardly from the retainer portion.

11. The display structure of claim 10, wherein the cap comprises a front surface, a back surface, at least a first and a second integral tab extending along at least two opposing sides of the cap and at least one aperture extending from the front surface to the back surface, each of the first and second integral tab being bent along the sides of the cap such that a back surface of each tab faces the back surface of the cap.

12. The display structure of claim 11, wherein each aperture of the cap aligns with each aperture of the front face and each aperture of the substrate to receive the fabric swatch.

13. The display structure of claim 11, wherein each aperture of the front face, each aperture of the substrate and each aperture of the cap comprises a width and a height, the width being greater than the height.

14. The swatch and sign holder of claim 10, further comprising a swatch held within each aperture of the front face and each aperture of the substrate, the swatch configured to be secured to a plurality of hook or loop pieces mounted to the back surface of the front face.

15. A method of altering a display structure comprising:

obtaining a display structure including a retainer portion coupled to a distal end of an arm, the retainer portion including a plurality of flanges located on two opposing sides and at least one open side;

obtaining a base including a front face and a receiver having at least a pair of spacers and a frame that are mounted to a back surface of the front face, wherein the front face includes at least one through slot extending from a front surface to the back surface of the front face;

engaging a back surface of a sign to the front surface of the front face, wherein the sign includes at least one through slot extending from the back surface to a front surface of the sign, the at least one through slot of the sign located in alignment with the at least one through slot of the front face;

securing the sign to the front face with a cover; and engaging portions of the frame with the flanges of the display structure such that the front face, the sign and the cover protrude outwardly from the retainer portion via the pair of spacers.

16. The method of claim 15, further comprising inserting a fabric swatch into both the at least one through slot in the sign and the at least one through slot in the front face.

17. The method of claim 15, further comprising mounting at least one hook or loop piece to the back surface of the front face.

18. The method of claim 17, wherein mounting the at least one hook or loop piece to the back surface of the front face comprises mounting the at least one hook or loop piece above the at least one through slot in the front face.

19. The method of claim 18, further comprising inserting a fabric swatch into both of the at least one through slot in the sign and the at least one through slot in the front face and securing the fabric swatch to the at least one hook or loop piece.

* * * * *